US010780958B2

(12) United States Patent
Paull

(10) Patent No.: US 10,780,958 B2
(45) Date of Patent: Sep. 22, 2020

(54) OPEN/NON-CLOSED, BUOYANT HULL COLLAR ASSEMBLIES

(71) Applicant: ARMOR INDUSTRIES, LLC, Duvall, WA (US)

(72) Inventor: Adam Jason Paull, Duvall, WA (US)

(73) Assignee: Armor Industries, LLC, Duvall, WA (US)

( * ) Notice: Subject to any disclaimer, the term of this patent is extended or adjusted under 35 U.S.C. 154(b) by 0 days.

(21) Appl. No.: 16/417,409

(22) Filed: May 20, 2019

(65) Prior Publication Data

US 2020/0031436 A1 Jan. 30, 2020

Related U.S. Application Data

(63) Continuation of application No. 16/047,947, filed on Jul. 27, 2018, now Pat. No. 10,336,414.

(51) Int. Cl.

| | |
|---|---|
| ***B63B 43/14*** | (2006.01) |
| ***B63B 17/00*** | (2006.01) |
| ***B63B 59/02*** | (2006.01) |
| *B63B 1/18* | (2006.01) |

(52) U.S. Cl.

CPC ..... *B63B 43/14* (2013.01); *B63B 17/00* (2013.01); *B63B 59/02* (2013.01); *B63B 2001/186* (2013.01); *B63B 2017/0045* (2013.01); *B63B 2231/10* (2013.01); *B63B 2231/50* (2013.01)

(58) Field of Classification Search

CPC .... B63B 3/00; B63B 3/08; B63B 3/14; B63B 43/00; B63B 43/04; B63B 43/12; B63B 43/14; B63B 59/00; B63B 59/02; B63B 17/00

USPC ..... 114/360, 364, 219; 405/215

See application file for complete search history.

(56) References Cited

U.S. PATENT DOCUMENTS

| | | | |
|---|---|---|---|
| 4,802,435 | A | 2/1989 | Choi |
| 5,184,566 | A | 2/1993 | Cochran |
| 5,878,685 | A | 3/1999 | Hemphill et al. |
| 10,336,414 | B1 | 7/2019 | Paull |
| 2009/0293789 | A1 | 12/2009 | Hansen et al. |

*Primary Examiner* — Lars A Olson

(74) *Attorney, Agent, or Firm* — Maschoff Brennan; Jason W. Croft

(57) ABSTRACT

An embodiment includes an open/non-closed hull collar assembly that is shaped to increase encapsulated volume of a hull. The hull collar assembly may include a hull collar structure and a foam module. The hull collar structure may include a gunwale, an outboard boundary, and an inboard boundary. The outboard boundary extends in an outward lateral direction from a lower hull portion and extends in a longitudinal direction from the lower hull portion such that at least a portion of the hull collar structure is at least partially included in a freeboard portion of a boat hull. The inboard boundary extends from the gunwale a portion of a distance to a deck such that the hull collar structure is at least partially open or non-closed to an inner hull volume. The foam module is comprised of a non-expansive, closed cell foam. The foam module is shaped for disposition within the hull collar structure.

20 Claims, 14 Drawing Sheets

OPEN/NON-CLOSED, BUOYANT HULL COLLAR ASSEMBLIES

CROSS-REFERENCE TO RELATED APPLICATIONS

This application claims priority to and the benefit of U.S. patent application Ser. No. 16/047,947, filed Jul. 27, 2018, which is incorporated herein by reference in its entirety.

FIELD

The embodiments discussed herein are related to boat hulls and in particular some embodiments relate to rigid buoyant boat hulls with open/non-closed, buoyant collar assemblies.

BACKGROUND

Boat hulls may include a collar assembly located in the outward uppermost portion of the boat hull. This flotation may be filled with air, foam, or combination thereof. The location of this buoyant material provides increased stability particularly in the advent water intrusion or a swamped state. Hence, it is ideal to achieve level floatation in these adverse conditions.

In general, the air and/or the foam are sealed in the collar assembly. For instance, the collar assembly may be comprised of a collar structure that defines a closed volume in which the air or the foam is disposed. Traditional rigid tubular collar assemblies have several drawbacks. For instance, these types of air-filled assemblies maintain a closed volume. In the advent of a puncture or water intrusion, the closed volume will increase in displacement and therefore suffer from a decrease in stability and performance. To offset these negative characteristics rigid tubular collar assemblies may implement chambers or expanding foam to mitigate water intrusion. The chambers add additional weight and manufacturing challenges and only partially mitigate the problem of increased displacement and decreased stability and performance. The expansion foam is sprayed or injected into the closed volume(s) and expands to fill or substantially fill the closed volume.

However, when the expansion foam is exposed to water, the expansion foam may absorb at least a portion of the water. Absorption of the water increases the weight of the collar assemblies and negatively affects the buoyancy, performance, and stability of the boat hull. Once the expanding foam absorbs water, it must be replaced.

Similarly, tubular non-rigid collar assemblies, such as utilized on Rigid-Hull Inflatable Boats (RHIBS), have several drawbacks. The non-rigid tubular collar assemblies rely on an outer protective membrane to provide a closed volume. The closed volume may be air-filled or filled with non-expanding foam. The outer protective membrane is prone to puncture, which may result in the loss of the buoyant properties, decreased performance, etc. Furthermore, the outer protective membrane is also prone to environmental (such as ultraviolet) damage and must be periodically replaced at significant cost. Lastly, the non-rigid tubular collar assemblies have no structural properties. Accordingly, the non-rigid tubular collar assemblies are often subject to damage, and increase hull resistance, with dynamic loading and maneuvering operations.

The subject matter claimed herein is not limited to embodiments that solve any disadvantages or that operate only in environments such as those described above. Rather, this background is only provided to illustrate one example technology area where some embodiments described herein may be practiced.

SUMMARY

The embodiments discussed herein are related to boat hulls and in particular some embodiments relate to boat hulls with open/non-closed buoyant hull collar assemblies.

An aspect of an embodiment includes an open/non-closed hull collar assembly. The open/non-closed hull collar assembly may be shaped to increase the encapsulated volume of a hull. The hull collar assembly may include a hull collar structure, and a foam module, a panel, and a deck lip. The hull collar structure may be comprised of aluminum or an aluminum alloy. The hull collar assembly may include a gunwale, an outboard boundary, and an inboard boundary. The hull collar structure may define or include a foam cavity that receives the foam module. The outboard boundary may extend in an outward lateral direction from a lower hull portion. The outboard boundary may extend in a longitudinal direction from the lower hull portion such that at least a portion of the hull collar structure is at least partially included in a freeboard portion of a boat hull. In detail, the outboard boundary may include a first longitudinal element, a first angled element, a first lateral element, a second longitudinal element, and a second lateral element. The first longitudinal element may be connected to the gunwale at a first end. The first angled element may extend from a second end of the first longitudinal element. The first lateral element may extend in an outboard direction from the lower hull portion. The second longitudinal element may be connected to the first lateral element and extending in the longitudinal direction from the first lateral element. The second lateral element may extend in the outboard direction from the second longitudinal element and connects to the first angled element. The lip structure may include a lateral portion and a longitudinal portion. The panel may be sized to extend from the longitudinal portion of the lip structure towards the deck in the longitudinal direction to at least partially close the hull collar structure relative to the inner hull volume. The inboard boundary may extend from the gunwale a portion of a distance to the deck such that the hull collar structure is at least partially open or non-closed to an inner hull volume. The inboard boundary may include a first longitudinal element that connects to the gunwale at a first end. The inboard boundary may include a lip structure at a free end that is opposite the first end. The foam module may include a recess that is configured to at least partially receive the lip structure such that the foam module is substantially retained relative to the hull collar structure. The lip structure may include multiple parts such as a lateral portion and a longitudinal portion. The panel is sized relative to one or more features of the open/non-closed hull collar assembly. For instance, the panel may be sized to extend from the longitudinal portion of the lip structure towards the deck in the longitudinal direction to at least partially close the hull collar structure relative to the inner hull volume. The foam module may be comprised of a non-expansive, closed cell foam. The foam module may be shaped for disposition within the hull collar structure. The foam module may only fill a portion of the hull collar structure. The foam module may be preformed to correspond to at least a portion of the foam cavity. The foam module may be comprised of a polyethylene foam. The panel may be comprised of a ballistic material. The panel may be sized to extend from the inboard boundary to the deck in the longitudinal direction and to at least partially close the hull collar structure relative to the inner hull volume. The panel may be sized in the longitudinal direction to cover a first distance that is greater than a second distance between the longitudinal portion of the lip structure and the deck lip. The deck lip may be coupled to at least a part of a perimeter of the deck. The deck lip may protrude in the longitudinal direction towards the inboard boundary. The deck lip may be configured to direct water towards an aft portion of a hull. The deck lip may reduce or substantially prevent introduction of the water into a foam cavity defined by the hull collar structure from the deck. The deck lip and a longitudinal portion of the lip structure may be positioned at substantially a same distance outboard from a keel. The foam cavity that may substantially correspond to the shape of the foam module. The foam cavity may include a lower volume and an upper volume. The upper volume of the foam cavity may include a greater lateral dimension than the lower volume such that an outboard portion of the upper volume is disposed farther outboard than the lower volume. The upper volume may include an uppermost portion that may be positioned immediately below the gunwale. The uppermost portion may include an inward portion that may be disposed inboard of an innermost dimension of the lower volume. The lower volume may include a portion that may be configured to be at least partially below a dynamic draft line of the boat. The upper volume may be configured to be above the draft line.

Another aspect of an embodiment includes a boat hull. The boat hull may include a lower hull portion, a deck, a foam module, an open/non-closed hull collar assembly, a panel, and a deck lip. The lower hull portion may include an outer surface that may be configured for contact with water when the boat hull is in water. The deck may be coupled to the lower hull portion via a plurality of ribs. The foam module is comprised of a non-expansive, closed cell foam. The open/non-closed hull collar assembly may increase the encapsulated volume. The hull collar assembly may define a foam cavity that substantially corresponds to at least a part of the foam module. The foam cavity may include a lower volume and an upper volume. The upper volume of the foam cavity may include a greater lateral dimension than the lower volume such that an outboard portion of the upper volume is disposed farther outboard than the lower volume. The upper volume may include an uppermost portion that is positioned immediately below the gunwale. The uppermost portion may include an inward portion that may be disposed inboard of an innermost dimension of the lower volume. The lower volume may include a portion that is configured to be at least partially below a dynamic draft line of the boat. The upper volume may be configured to be above the draft line. The open/non-closed hull collar assembly may include a gunwale, an outboard boundary, and an inboard boundary. The outboard boundary may extend in an outward lateral direction from the lower hull portion and may extend in a longitudinal direction from the lower hull portion such that at least a portion of the hull collar structure may be included in a freeboard portion of the boat hull. In detail, the outboard boundary may include a first longitudinal element, a first angled element, a first lateral element, a second longitudinal element, or a second lateral element. The first longitudinal element may be connected to the gunwale at a first end. The first angled element may extend from a second end of the first longitudinal element. The first lateral element may extend in an outboard direction from the lower hull portion. The second longitudinal element may be connected to the first lateral element and extending in the longitudinal direction from the first lateral element. The second lateral element may extend in the outboard direction from the second longitudinal element and connect to the first angled element. The lip structure may include a lateral portion and a longitudinal portion. The panel may be sized to extend from the longitudinal portion of the lip structure towards the deck in the longitudinal direction to at least partially close the hull collar structure relative to the inner hull volume. The inboard boundary may extend from the gunwale a portion of a distance to the deck such that the hull collar structure is at least partially open or non-closed to an inner hull volume. The inboard boundary may include a first longitudinal element that connects to the gunwale at a first end and a lip structure at a free end that is opposite the first end. The foam module may include a recess that may be configured to at least partially receive the lip structure such that the foam module is substantially retained relative to the hull collar structure. The panel may be sized to extend from the inboard boundary to the deck in the longitudinal direction and to at least partially close the hull collar structure relative to the inner hull volume. The panel may be sized in the longitudinal direction to cover a first distance that is greater than a second distance between the longitudinal portion of the lip structure and the deck lip. The foam module may be configured such that the boat hull substantially complies with level floatation requirements. The boat hull may include a centerline length that is fewer than about 65 feet. The deck lip may be positioned along at least a perimeter of the deck. The deck lip may protrude in the longitudinal direction towards the inboard boundary. The deck lip may be configured to direct water towards an aft portion of a hull. The deck lip may substantially prevent introduction of the water into a foam cavity defined by the hull collar structure from the deck. The deck lip and a longitudinal portion of the lip structure may be positioned at substantially a same distance outboard from a keel.

The object and advantages of the embodiments will be realized and achieved at least by the elements, features, and combinations particularly pointed out in the claims.

It is to be understood that both the foregoing general description and the following detailed description are exemplary and explanatory and are not restrictive of the invention, as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1A:
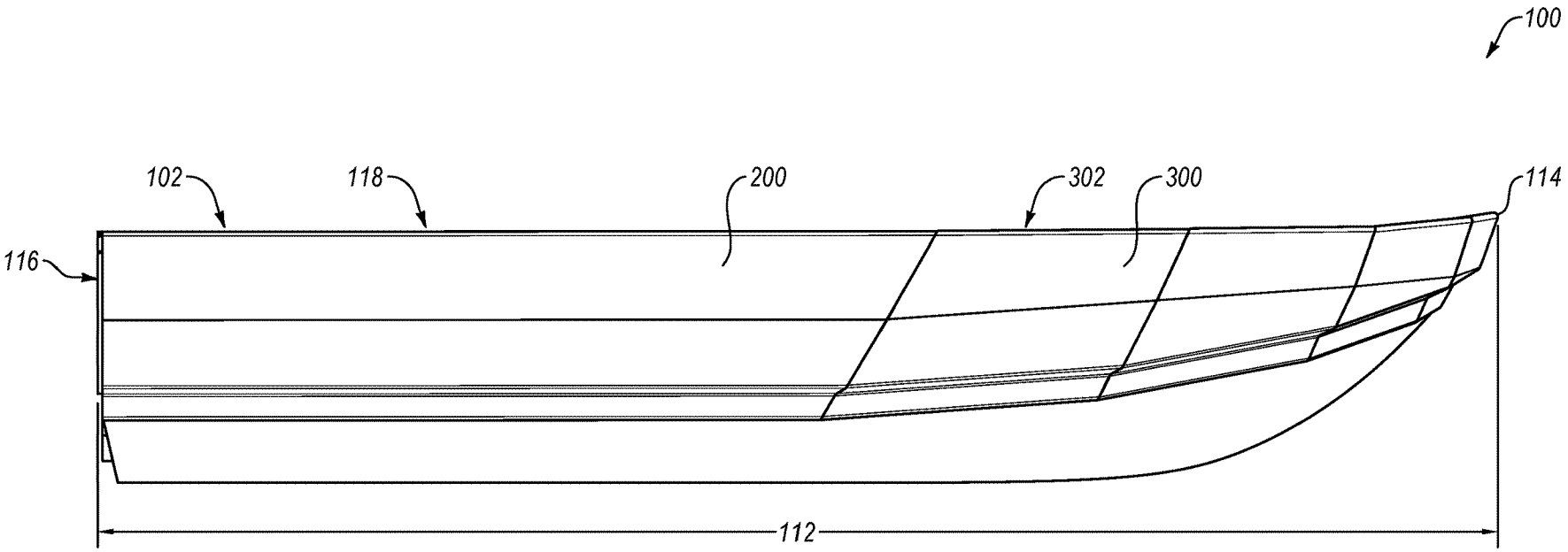
FIG. 1A illustrates an example boat hull that may implement one or more embodiments of the present disclosure.

The embodiments discussed herein are related to boat hulls and in particular, some embodiments relate to boat hulls with open/non-closed hull collar assemblies. Conventional boat hulls may include a collar assembly at a top portion of a boat hull. These collar assemblies generally include closed or sealed volumes that are filled with expansion foam and/or air. Construction and maintenance of the closed volumes may be resource intensive. For instance, the construction of the closed volume may include a welded seam that must be airtight. Moreover, damage to the collar assemblies may result in introduction of water to the foam or the closed volume that may create negative buoyancy.

Accordingly, some embodiments disclosed in the present application include an open/non-closed hull collar assembly. The collar assembly may be shaped to increase encapsulated volume of a hull relative to similar boats with closed collar assemblies. The hull collar assembly may include a hull collar structure and a foam module. The foam module is comprised of a non-expansive, closed cell foam. Consequently, exposure of the foam module to water does not affect or minimally affects its weight or buoyancy. The hull collar structure may be constructed of aluminum or another suitable material and may comprise a gunwale, an outboard boundary, and an inboard boundary. The hull collar structure defines a foam cavity in which the foam module is disposed. The hull collar structure is sized and dimensioned such that it is open or non-closed to the encapsulated volume of a boat hull. For instance, the inboard boundary extends from the gunwale a portion of a distance to a deck such that the hull collar structure is at least partially open or non-closed. The foam module is shaped for disposition within the hull collar structure. A panel may be placed along the open boundary of the hull collar structure in some embodiments. The panel may be comprised of a ballistic material, which may be projectile resistant or another suitable material. The panel may enable a particular function of the collar assembly such as police or military implementations.

The open construction or non-closed construction may provide multiple improvements over closed collar assemblies. For instance, the open construction or non-closed construction may simplify construction of the collar assembly. For example, the open/non-closed hull collar assembly may not include a water/air tight seam and/or may not be hermetically sealed at least during a portion of the life of the boat hull 100, which may reduce resources involved in construction. Additionally, the open construction or non-closed construction may reduce the amount of material used in the construction or enable reallocation of such material to external portions of the collar assembly compared to closed collar assemblies. This and other embodiments are described with reference to the Figures. In the Figures, components and features with like numbers indicate similar function and structure unless described otherwise.

Figure 1B:
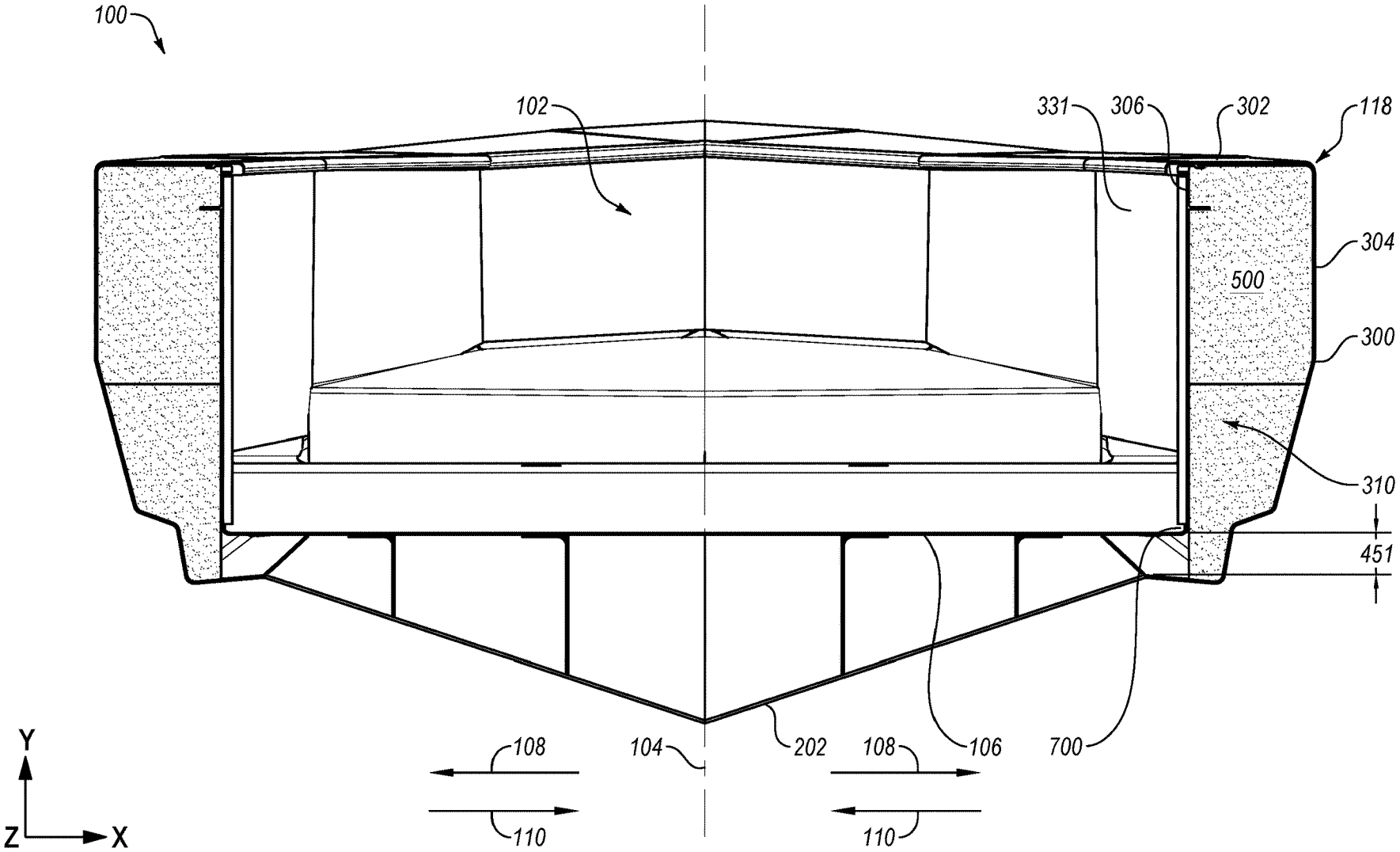
FIG. 1B is another view of the boat hull of FIG. 1A.
Figure 1C:
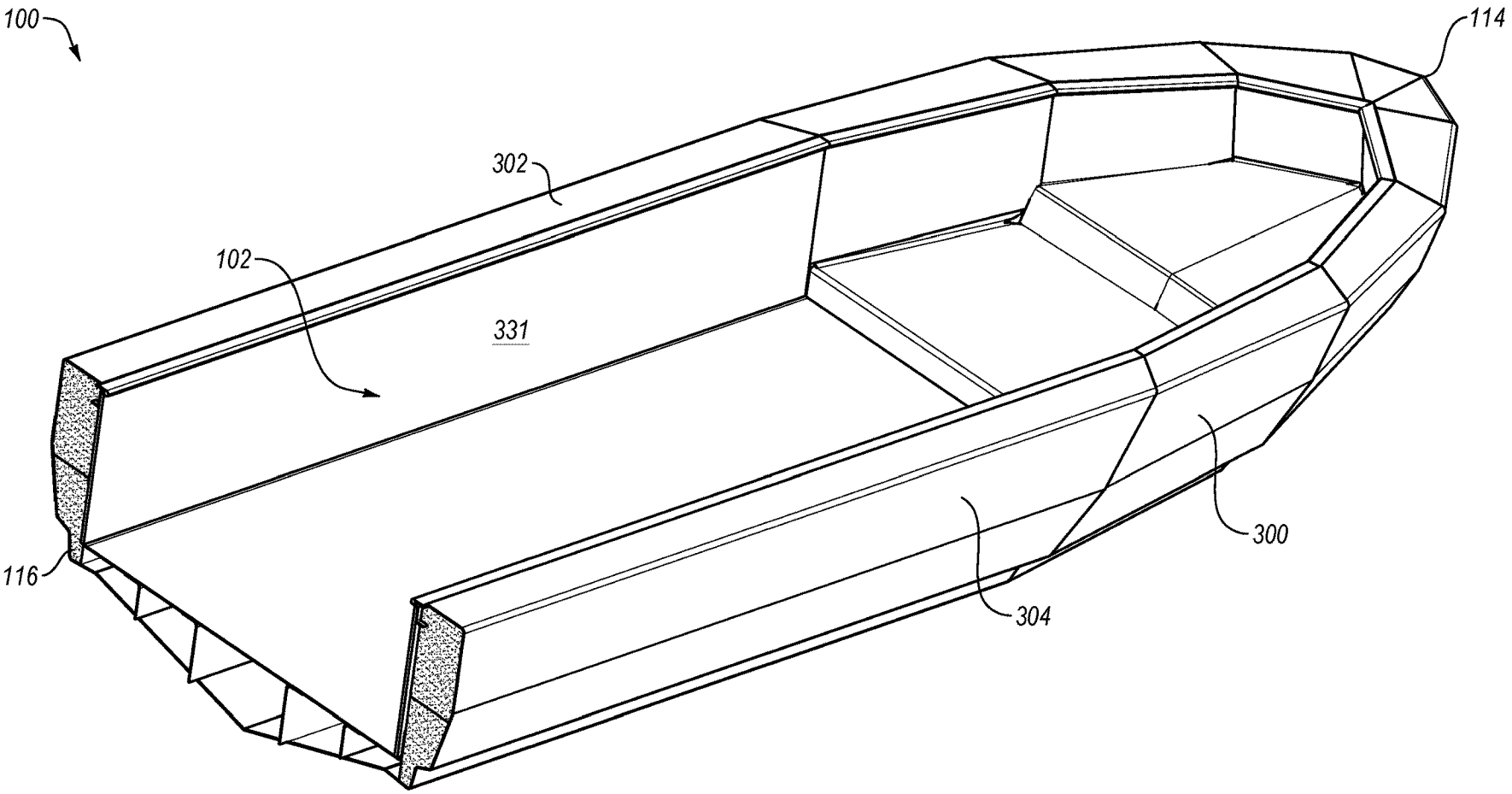
FIG. 1C is another view of the boat hull of FIG. 1A.
Figure 1D:
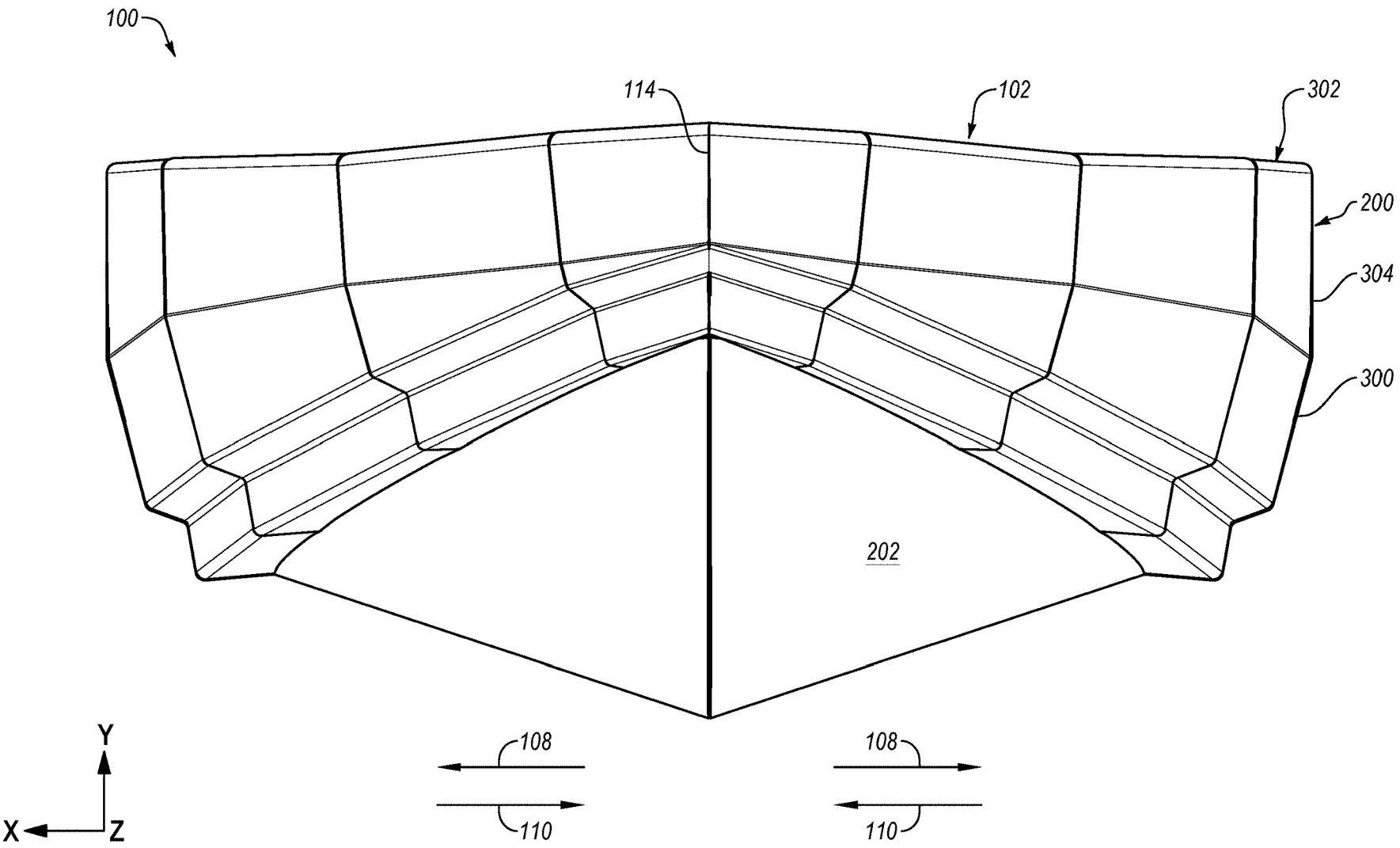
FIG. 1D is another view of the boat hull of FIG. 1A.
Figure 1F:
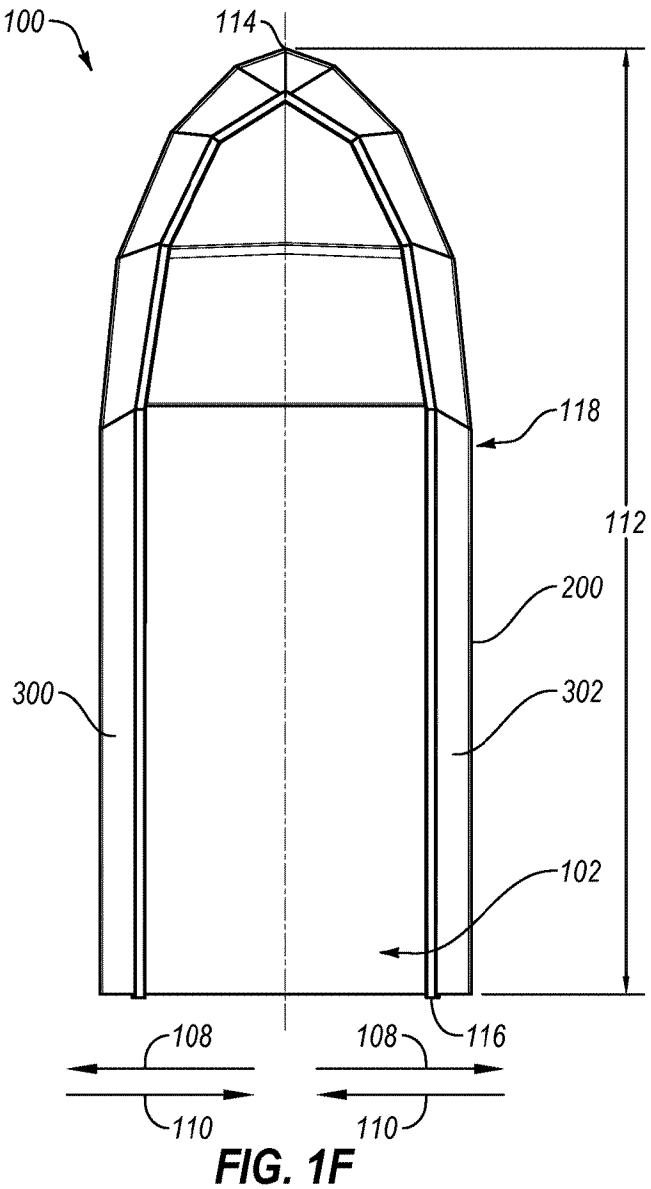
FIG. 1F is another view of the boat hull of FIG. 1A.
Figure 1E:
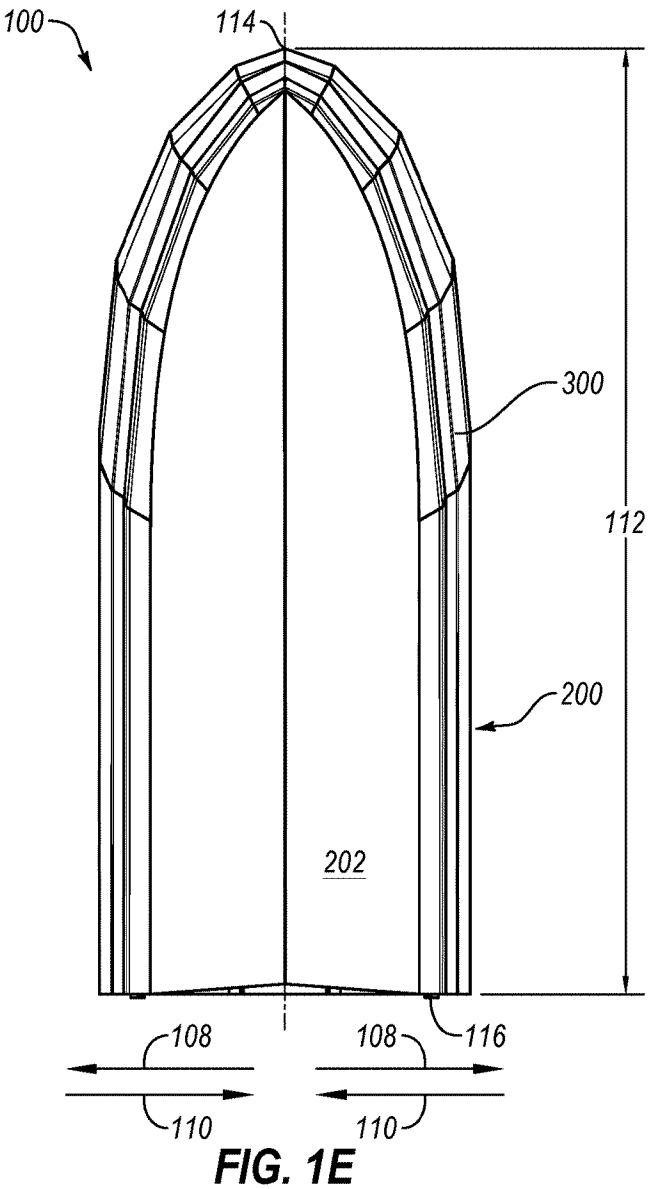
FIG. 1E is another view of the boat hull of FIG. 1A.

FIGS. 1A-1F depict an example boat hull 100 that may implement one or more embodiments of the present disclosure. FIG. 1A is a side view of the boat hull 100. FIG. 1B is a rear view of the boat hull 100. FIG. 1C is a perspective view of the boat hull 100. FIG. 1D is a front view of the boat hull 100. FIG. 1E is a bottom view of the boat hull 100. FIG. 1F is a top view of the boat hull 100. The boat hull 100 of FIGS. 1A-1F and discussed throughout the present disclose is depicted without a transom. Omission of the transom is not enables depiction of internal portions of the boat hull 100. One with skill in the art may understand with the benefit of this disclosure that a transom can be fit to the boat hull 100.

The boat hull 100 may be implemented in a military boat, police boat, a recreational boat, or another boat. In some embodiments, some dimensions and/or materials may vary between implementations. For instance, in embodiments in which the boat hull 100 is configured for a military implementation, a panel (described below) may be larger and constructed of a ballistic material. In other embodiments in which the boat hull 100 is configured for a recreational use, the panel may be constructed of fiberglass, thermoformed plastic, other suitable materials, or combinations thereof. Alternatively, in some embodiments, the panel may be omitted or may include a smaller panel compared to those describe in the present disclosure.

In some embodiments, the panel may be molded for a specific purpose or implementation. For example, the boat hull 100 may be constructed for a recreational purpose. In these and other embodiments, the panel may be constructed similar to a door panel in an automobile. For instance, the panel may enable goods or equipment to be stored in a cavity formed in the panel. Additionally or alternatively, in some embodiments, the panel may be formed using a vacuum forming process.

The boat hull 100 may include a bow 114, a stern 116, and an open/non-closed hull collar assembly (hereinafter, "collar assembly") 200 that extends along sides or at least portions of the sides of the boat hull 100 that extend between the bow 114 and the stern 116. For example, in the depicted embodiment, the collar assembly 200 may be along each of the sides of the boat hull 100. Additionally, the collar assembly 200 is included in an upper portion 118 of the boat hull 100 near or including a gunwale 302.

The collar assembly 200 may be shaped to increase an encapsulated volume 102 (FIGS. 1B, 1C, and 1F) of the boat hull 100 relative to other collar assemblies of other boat hulls. For instance, the collar assembly 200 may include a shape and a configuration in which the collar assembly 200 is positioned in an outboard portion of the boat hull 100. With reference to FIG. 1B, 1D-1F, the term "outboard" corresponds to a direction away from a centerline 104 of the boat hull 100. The centerline 104 may be positioned at a center of a lateral dimension of the boat hull 100, which corresponds to the x-direction of FIG. 1B. The centerline 104 may correspond to a centerline of a beam in some embodiments. Conversely, the term "inboard" may correspond to a direction towards the centerline 104 of the boat hull 100. In FIG. 1B, outboard is represented by arrow 108 and inboard is represented by arrow 110. A similar convention is illustrated in FIGS. 1D-1F.

The encapsulated volume 102 accordingly includes a volume that is defined between a deck 106 and the collar assembly 200. In the depicted embodiment, the encapsulated volume 102 is open at the top. In other embodiments, the encapsulated volume 102 or a portion thereof may be closed on a top to create a cabin.

The collar assembly 200 may be open, non-closed, or partially open to the encapsulated volume 102. For instance, the collar assembly 200 may in be comprised of a hull collar structure 300. The hull collar structure 300 may include the gunwale 302, an outboard boundary 304, and an inboard boundary 306. The inboard boundary 306 may not extend an entire distance to the deck 106. Accordingly, the hull collar structure 300 is closed along the gunwale 302 and the outboard boundary 304, and is open between the inboard boundary 306 and the deck 106.

In the embodiment of FIG. 1B, the hull collar structure 300 may include a panel 331. The panel 331 may be fit or selectively attached to the hull collar structure 300. The panel 331 may accordingly close or partially close the collar assembly 200 to the encapsulated volume 102.

Additionally, in the embodiment of FIG. 1B, the inboard boundary 306 may be a separate structure that may be coupled to the gunwale 302 at a joint 349. For instance, the inboard boundary 306 may be an independent structure that is welded or otherwise coupled to the gunwale 302. In other embodiments, the inboard boundary 306 may be integrally formed or attached to the gunwale 302.

The deck 106 may be connected to a lower hull portion 202 by one or more vertical supports 204. The lower hull portion 202 may be configured to be placed in the water when the boat hull 100 is operating. The collar assembly 200 may be connected to the lower hull portion 202. For instance, the collar assembly 200 may be implemented at the outboard edge of the lower hull portion 202.

In the embodiments depicted in the present disclosure, the panel 331 may rest on an inboard surface of the deck lip 700. Accordingly, the panel 331 may accordingly extend a part or portion of the distance between the inboard boundary 306 to the deck 106. In other embodiments, the deck lip 700 may extend towards the lower hull portion 202 at the outboard edge of the deck 106. In these and other embodiments, the panel 331 may extend below the deck 106. Accordingly, the outboard edge of the deck 106 may be positioned some distance from a lowermost end of the panel 331.

The collar assembly 200 may define a foam cavity 310. For instance, the gunwale 302, the outboard boundary 304, and the inboard boundary 306 may define boundaries of the foam cavity 310. A foam module 500 may be deposed in the foam cavity 310 or at least in a portion of the foam cavity 310. The foam module 500 may be comprised of a non-expansive, closed cell foam. Accordingly, the foam module 500 may not increase in weight or may not significantly increase in weight when exposed to water.

In addition, the foam module 500 may have a density that is less than water. Consequently, the foam module 500 may increase buoyancy of the boat hull 100. The collar assembly 200 and/or the foam module 500 may be configured such that the boat hull 100 substantially complies with or exceeds level floatation requirements. Some examples of the level floatation requirements may be found in NSCV Subsection C6B, AS1799.1, ISO 12217-3, and ABYC H-8, which are incorporated herein by reference in their entireties. Additionally or alternatively, the foam module 500 may be sized to provide basic floatation or greater per 33 C.F.R. § 183.105 (2018). Further, the foam module 500 may be sized and placed to provide sufficient buoyancy to pass the stability and flotation tests prescribe in 33 C.F.R. §§ 183.225(a), 183.230(a), and 183.235(a) (2018). These sections of the C.F.R. are incorporated herein by reference in their entireties.

Referring to FIG. 1A, the boat hull 100 may include a centerline length 112. The centerline length 112 may be determined along the centerline 104 and/or along a beam of the boat hull 100. In some embodiments, the centerline length 112 may be less than about 65 feet. At about 65 feet, the level flotation requirements may not be as important as in boat hulls 100 that have centerline lengths 112 that are less than about 65 feet. For instance, some embodiments include boat hulls with a centerline length 112 of less than about 50 feet, less than about 40 feet, or another suitable dimension.

In some embodiments, the boat hull 100 may be implemented in or be used to construct a rigid buoyant boat. In rigid buoyant boats, the boat hull 100 may be manufactured from a solid material, which may include polyethylene, aluminum alloy, or aluminum. The rigid buoyant boats may implement the foam module 500. The rigid buoyant boats may be constructed such that the rigid buoyant boats are buoyant even when the boat hull 100 is flooded. The rigid buoyant boats may be more robust than similar boats that implement fabrics or flexible plastics for the hull.

The boat hull 100 in FIGS. 1A-1F depict a structure that is substantially a monohull structure. In other embodiments, the boat hull 100 may be a multihull structure. For instance, the boat hull 100 may include two, three, or another suitable number of hull structures.

Modifications, additions, or omissions may be made to the boat hull 100 without departing from the scope of the present disclosure. For instance, the boat hull 100 may be implemented in a boat or ship, which may include other components and systems such as an engine, seats, etc. Additionally, the boat hull 100 may implement the collar assembly 200 along only a portion of the sides. Additionally, the boat hull 100 may implement an example of the collar assembly 200 at a top portion of the boat hull 100, at a bottom portion of the boat hull 100, etc. the collar assembly 200 may be implemented with one or more additional buoyancy systems. Moreover, the separation of various components in the embodiments described herein is not meant to indicate that the separation occurs in all embodiments. For example, the collar assembly 200 is shown as being separate from the deck 106 and the lower hull portion 202. In other embodiments, the collar assembly 200 may be formed of a single piece of material with the lower hull portion 202 and/or the deck 106.

Figure 2:
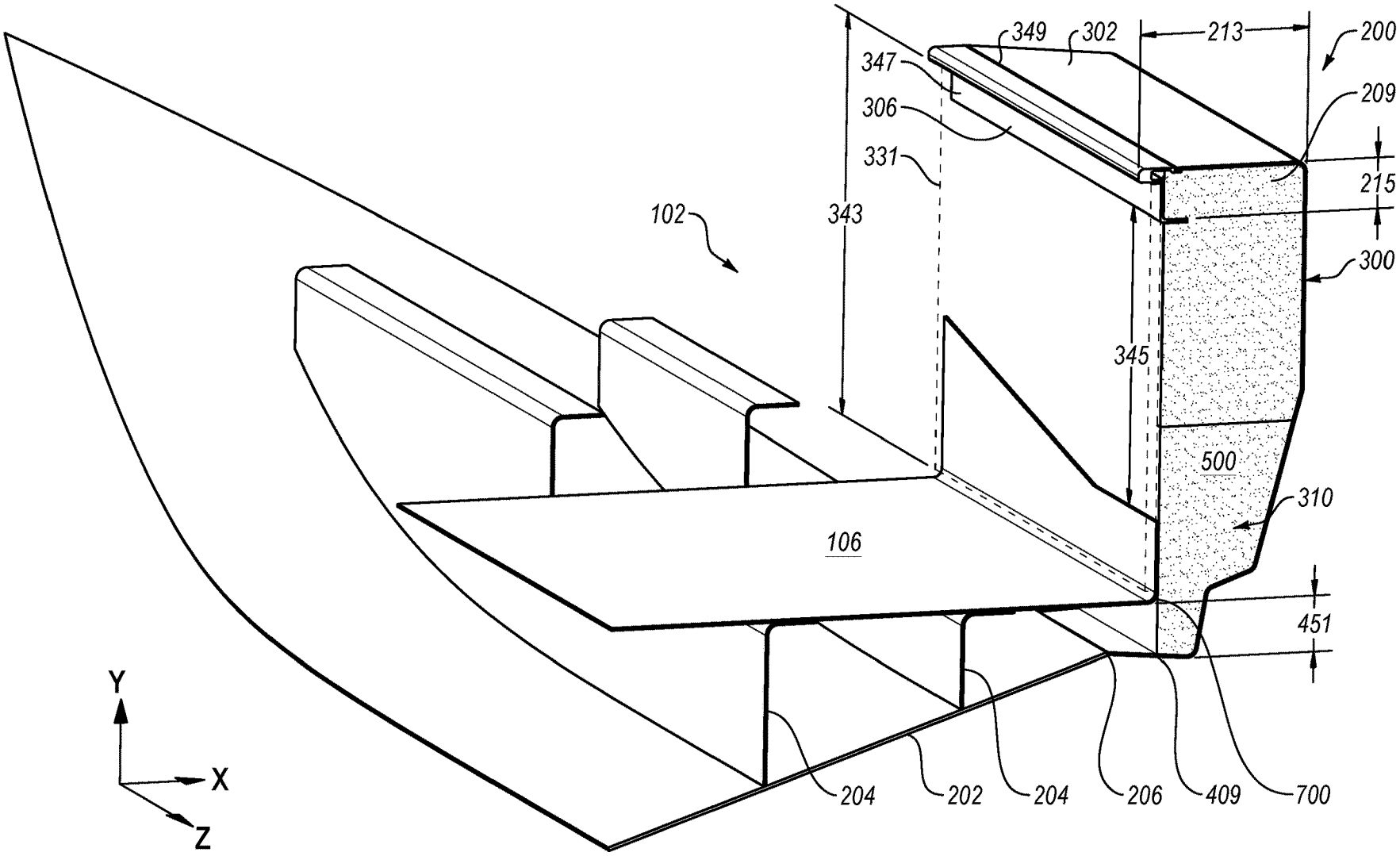
FIG. 2 illustrates an example collar assembly that may be implemented in the boat hull of FIGS. 1A-1F.

FIG. 2 depicts a portion of an example embodiment of the collar assembly 200 introduced in FIGS. 1A-1F. In FIG. 2, a perspective, sectional view of the collar assembly 200 is depicted. The collar assembly 200 of FIG. 2 may be implemented in the boat hull 100 of FIGS. 1A-1F or another suitable boat hull.

The collar assembly 200 is configured to increase or determine buoyancy of a boat hull such as the boat hull 100 of FIGS. 1A-1F. Additionally, the collar assembly 200 may determine, at least partially, buoyancy and performance characteristics of the boat hull. For example, the collar assembly 200 may be connected to or may otherwise extend from an outermost edge 206 of the lower hull portion 202. The collar assembly 200 may generally extend in a longitudinal direction (which may correspond to the y-direction of FIG. 2) from the gunwale 302 to the outermost edge 206 of the lower hull portion 202. In some embodiments, a portion of the collar assembly 200 may extend in a negative y-direction relative to the outermost edge 206. Accordingly, the foam cavity 310 defined by the collar assembly 200 includes a volume that is not wholly concentrated at the gunwale 302. Instead, the foam cavity 310 includes a portion that is bordered by the gunwale 302 and that extends longitudinally a part or a majority of a distance to the lower hull portion 202. The shape of the foam cavity 310 distributes the volume along a relatively large longitudinal portion of the side of the boat hull 100 when compared to conventional boat hulls.

The collar assembly 200 may further extend in an outboard direction from the outermost edge 206 of the lower hull portion 202 and/or a plane that is substantially parallel to the YZ plane inclusive of the outermost edge 206. Accordingly, the foam cavity 310 defined by the collar assembly 200 includes a volume that is substantially outboard of the lower hull portion 202. Moreover, the buoyant material (e.g., the foam module 500) is distributed outboard of the lower hull portion 202 and increases in volume as a distance from the lower hull portion 202 increases.

In the depicted embodiment, an uppermost portion of the collar assembly 200 may have an enlarged volume 209. The enlarged volume 209 may have an enlarged width 213 over a particular portion 215 of the height. The enlarged width 213 may include a part of the foam cavity 310 that extends inboard of the plane that includes the outermost edge 206. The enlarged volume 209 may accordingly overhang into the encapsulated volume 102.

The hull collar structure 300 of the collar assembly 200 may extend along at least a portion of a perimeter of the boat hull. In some embodiments, the collar assembly 200 extends along an entire perimeter of the boat hull. In other embodiments, the collar assembly 200 may include different dimensions at particular portions of the perimeter. In some embodiments, the hull collar structure 300 may be welded or otherwise coupled to the lower hull portion at the outermost edge 206. In other embodiments, the collar structure 300 may be made of a single piece of material with the lower hull portion 202. In some embodiments the collar structure 300 may be comprised of multiple components welded together. For example, in these and other embodiments, chines 575 and 577 (described with reference to FIG. 3C) may be comprised of an extrusion that is welded to a first lateral element 409 and a first angled element 407 (described with reference to FIG. 4).

Figure 3A:
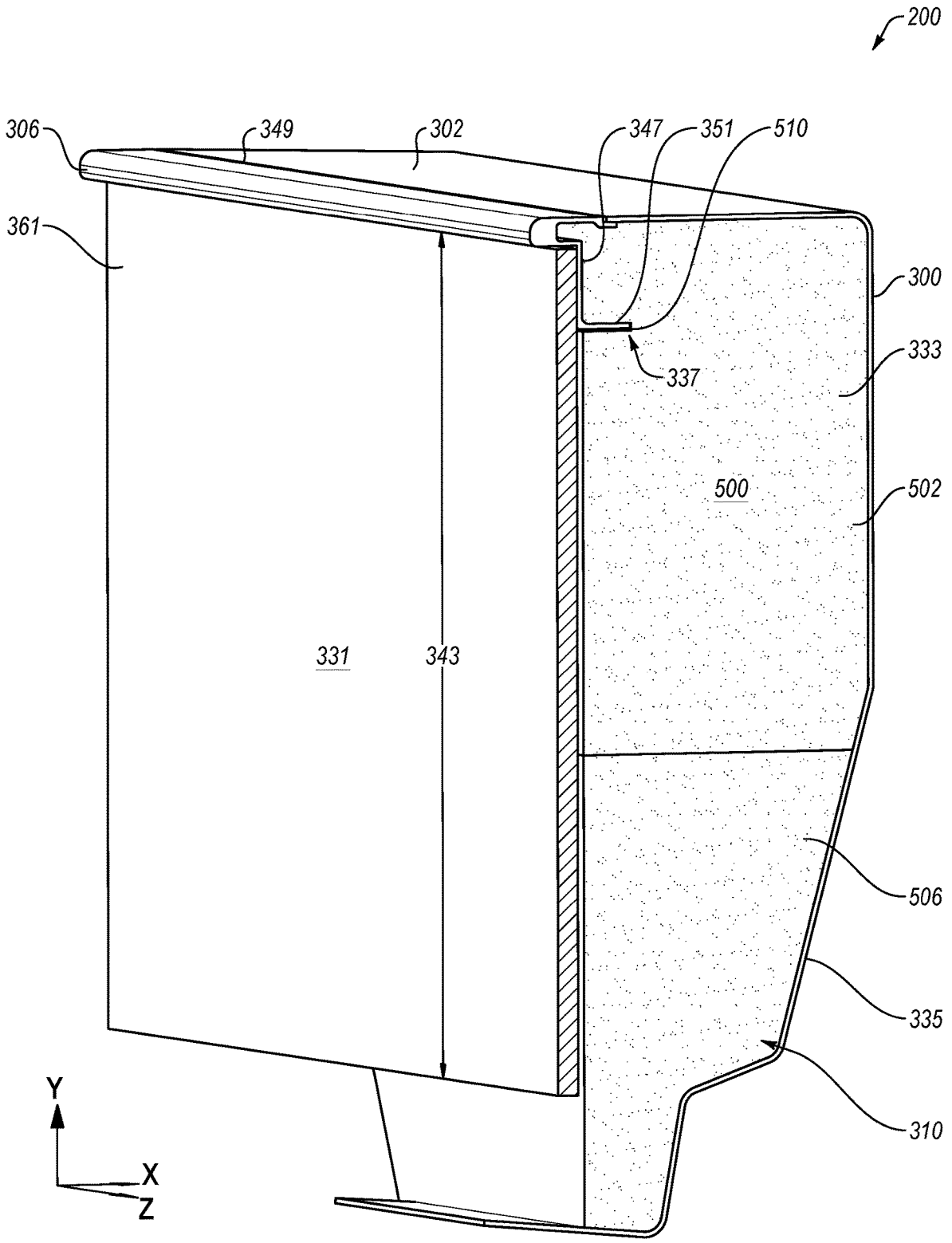
FIG. 3A illustrates another view of the collar assembly of FIG. 2.
Figure 3B:
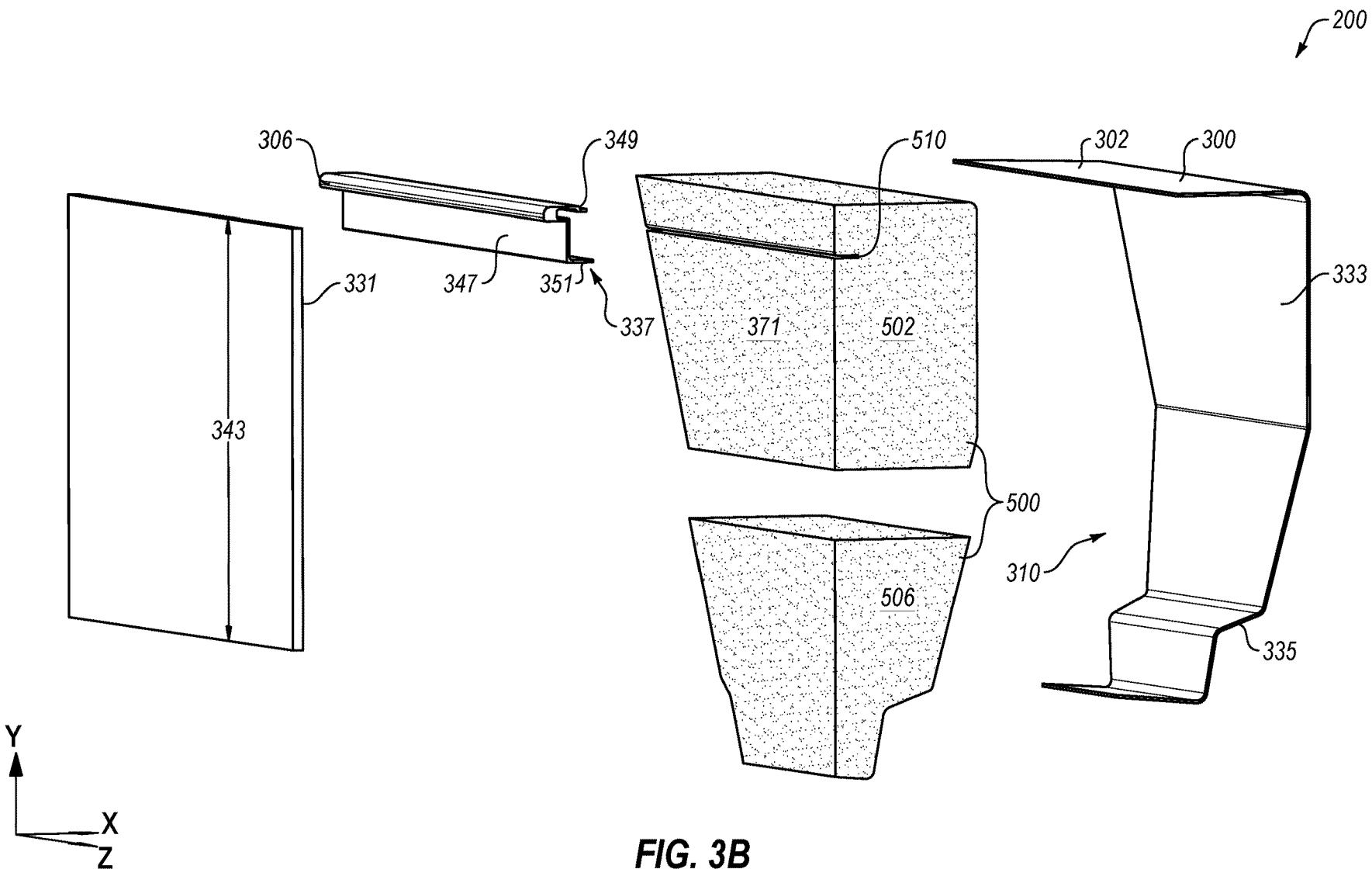
FIG. 3B illustrates an exploded view of the collar assembly of FIG. 3A.
Figure 3C:
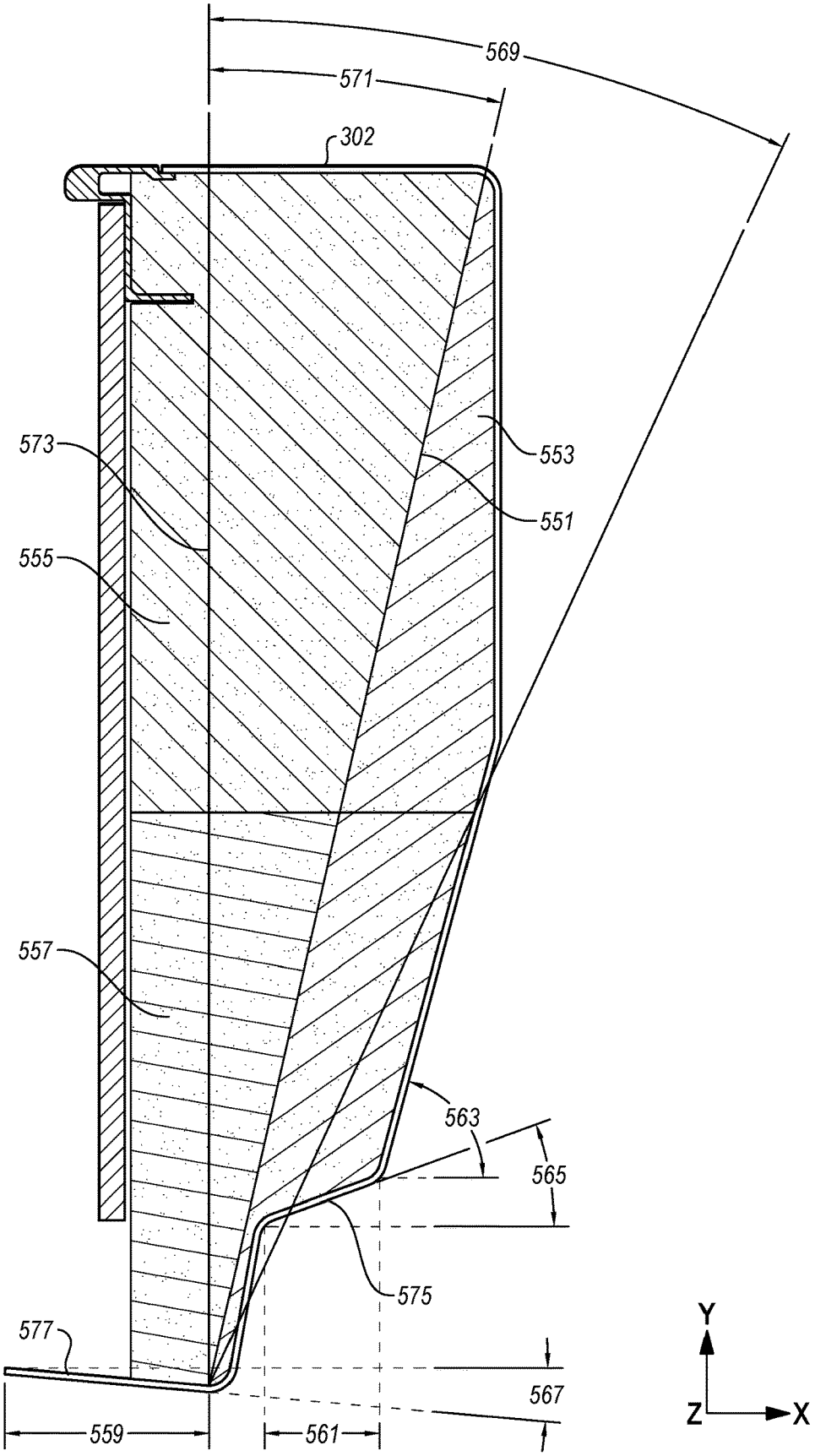
FIG. 3C illustrates an planar view of the collar assembly of FIG. 3A.

FIGS. 3A-3C illustrate an example embodiment of the collar assembly 200, which may be implemented in boat hulls such as the boat hull 100 of FIGS. 1A-1F. In FIG. 3A, the collar assembly 200 is depicted in an assembled configuration. FIG. 3B is an exploded view of the collar assembly 200. FIG. 3C is a planar view of the collar assembly 200. In FIGS. 3A-3C, there is a portion of the collar assembly 200 shown. The collar assembly 200 may extend around all or a portion of the boat hull.

The collar assembly 200 includes the hull collar structure 300, the foam module 500, and the panel 331. In the assembled configuration, the foam module 500 is disposed in the foam cavity 310. Additionally, the panel 331 may be placed against or adjacent to the foam module 500. The panel 331 may be placed against the foam module 500 such that an upper portion 361 of the panel 331 overlaps a portion of the inboard boundary 306 of the hull collar structure 300.

Referring to FIG. 3B, the foam module 500 may include an upper foam portion 502 and a lower foam portion 506. To assemble the collar assembly 200, the upper foam portion 502 may be disposed in the hull collar structure 300. The upper foam portion 502 may be received in an upper part 333 of the hull collar structure 300. For example, the upper foam portion 502 may be introduced into the upper part 333. The inboard boundary 306 may be placed against an inboard surface 371 of the upper foam portion 502. After the inboard boundary 306 is in place, the inboard boundary 306 may be welded to the gunwale 302. With the upper foam portion 502 positioned between the inboard boundary 306 and the upper part 333, the hull collar structure 300 may retain the upper foam portion 502. The hull collar structure 300 of FIGS. 3A-3C may include a lip structure 337. The lip structure 337 is configured to be received in a recess 510. When received in the recess 510, the lip structure 337 may retain the upper foam portion 502. Alternatively, the inboard boundary 306 may be welded or otherwise coupled to the gunwale 302. The upper foam portion 502 may be rotated into the upper part 333 and retained therein.

After the upper foam portion 502 is disposed in the hull collar structure 300, the lower foam portion 506 may be disposed in a lower part 335 of the hull collar structure 300. The lower foam portion 506 may be placed in the lower part 335 such that an upper surface of the lower foam portion 506 may contact a lower surface of the upper foam portion 502. In some embodiments, the lower foam portion 506 may be adhered or glued to the upper foam portion 502.

The panel 331 may then be placed against the foam module 500. The panel 331 is sized to extend from the inboard boundary 306 to a deck (e.g., 102 of FIGS. 1A-1F) in the longitudinal direction, which may be parallel to the y-direction of FIGS. 3A-3C. The panel 331 at least partially closes the hull collar structure 300 relative to an inner hull volume such as the encapsulated volume 102 of FIGS. 1A-1F.

In some embodiments, the lip structure 337 of the inboard boundary 306 may include a longitudinal portion 347. With reference to FIGS. 2-3C, the panel 331 may be sized to extend from the longitudinal portion 347 of the lip structure 337 towards the deck 106 in the longitudinal direction (e.g., the y-direction). As introduced above in FIG. 2, the deck lip 700 may extend in towards the lip structure 337. A longitudinal dimension 343 of the panel 331 may be greater than a distance 345 between the lip structure 337 and the deck lip 700. Accordingly, the panel 331 at least partially closes the hull collar structure 300 relative to the encapsulated volume 102.

Referring to FIG. 3C, the hull collar structure 300 may include a first chine 577 and a second chine 575. The first chine 577 may be inboard of the second chine 575. The first chine 577 may extend in an outboard direction from the lower hull portion 202 as well as in a longitudinal direction (negative or positive y-direction). The second chine 575 may increase a planing surface during heavily laden operation and may increase in buoyant volume when engaged as the vessel lists. During lighter operation and at higher planing speeds the second chine 575 is out of the water and therefore does not increase the resistance.

A first chine angle 567 may be defined from a portion of the hull collar structure 300 making up the first chine 577 (e.g., 409 described below) to a first substantially horizontal datum, which may be parallel to the x-axis in FIG. 3C. In some embodiments, the first chine angle 567 may be in a range of about −10 degrees to about 10 degrees and may be about −5 degrees in the depicted embodiment. A first chine width 559 (e.g., a width of 409) may be defined between the lower hull portion 202 to a longitudinal element (e.g., 411 described below). In some embodiments (e.g., with a centerline length 112 in a range of about 16 to about 65 feet), the first chine width 559 may be between about 2 and about 18 inches and may be about 6 inches in the depicted embodiment. The first chine width 559 may vary in accordance with its particular position on the boat hull 100 and in accordance with the vessel size and relative length to beam ratio.

A second chine angle 565 may be defined from a portion of the hull collar structure 300 (e.g., 413 described below) making up the second chine 575 to a second substantially horizontal datum, which may be parallel to the x-axis in FIG. 3C. In some embodiments, the second chine angle 565 may be in a range of about −10 degrees and about 50 degrees and may be about 20 degrees in the embodiment depicted in FIG. 3C. A second chine width 561 (e.g., a width of 413) may be defined between the longitudinal element coupled to the first chine 577 to a second angled element (e.g., 407 described below). In some embodiments (e.g., with a centerline length 112 in a range of about 16 to about 65 feet), the second chine width 561 (e.g., length of 413) may be between about 1 and about 10 inches. The second chine width 561 may vary in accordance with its particular position on the boat hull 100 and in accordance with the vessel size and relative length to beam ratio.

A third hull angle 563 may be defined between a third substantially horizontal datum that may be parallel to the x-axis and the second angled element (e.g., 407). In some embodiments, the third hull angle 563 may be in a range of about 0 degrees and about 90 degrees and may be about 75 degrees in the embodiment depicted in FIG. 3C. The hull collar structure 300 is structural and integrated into hull of vessel, which enables a large bottom surface, or planning area for deceased planing resistance with respect to overall beam when compared to other buoyant apparatuses.

In some embodiments, the gunwale 302 or a portion thereof may be positioned inboard of at least a portion of the first chine 577. In particular, an outboard edge of the first chine 577 may be positioned in a plane represented by a chine line 573. The chine line 573 extends in FIG. 3C to the gunwale 302. As shown in FIG. 3C, the gunwale 302 extends inboard of the chine line 573. Accordingly, a portion of the foam cavity 310 and foam module 500 is inboard of the first chine 577.

With continued reference to FIG. 3C, the foam cavity 310 of the hull collar structure 300 may be configured to increase an outboard volume relative to conventional boat hulls. For instance, some conventional vessel hull may be manufactured from planar materials (e.g., aluminum, plywood, steel, etc.). Most of these vessels hulls are bound by a developable surface on an outboard boundary. A developable surface is a surface that is formed from a flat sheet material without stretching (e.g., having no permanent deformation or bending). Mathematically the developable surface may be defined as having zero or substantially zero Gaussian curvature. A developable surface may be represented by a linear or near linear line that extends from the outward most portion of a chine to the outward most portion of the gunwale. These sides are generally angled outward from the chine to the outward most portion of the gunwale in a range of about 0 degrees (e.g., vertical) to about 23 degrees (angled outboard).

FIG. 3C includes a first line 551 that is representative of a conceptual plane of a developable surface that may be implemented in conventional boat hull. The first line 551 extends from the outermost edge of the first chine 577 to the outboard edge of the gunwale 302. The first line 551 may be at an angle 571 from the chine line 573. In some embodiments, the angle 571 may be about 13 degrees. The first line 551 may conceptually separate an expanded volume 553 from an upper inboard volume 555 and a lower inboard volume 557. The expanded volume 553 may be defined at least partially of the hull collar structure 300. For example, the embodiment of FIG. 3C utilizes the hull collar structure 300 that may be manufactured from planar material, but is non-developable, particularly when viewed as a singular component from the outboard chine to the gunwale 302. Outboard extension of the hull collar structure 300 beyond that of a developable surface (represented by the first line 551) in the expanded volume 553 between the outboard portion of the innermost primary chine and the outboard portion of the gunwale 302 to displace a greater volume of water as the boat lists than a conventional boat without the expanded volume 553.

The expanded volume 553 may increase the volume of the foam cavity 310. For example, in the depicted embodiment of FIG. 3C, the expanded volume 553 may include a cross-sectional area of about 88.1 square inches, the upper inboard volume 555 may be about 157.5 square inches, and the lower inboard volume 557 may be about 72.6 square inches. Accordingly, the inclusion of the expanded volume 553 may increase the volume of the 310 by about 39% (((157.5+72.6+88.1)/(157.5+72.6))−1). The larger volume may increase stability and may increase a righting moment.

Figure 4:
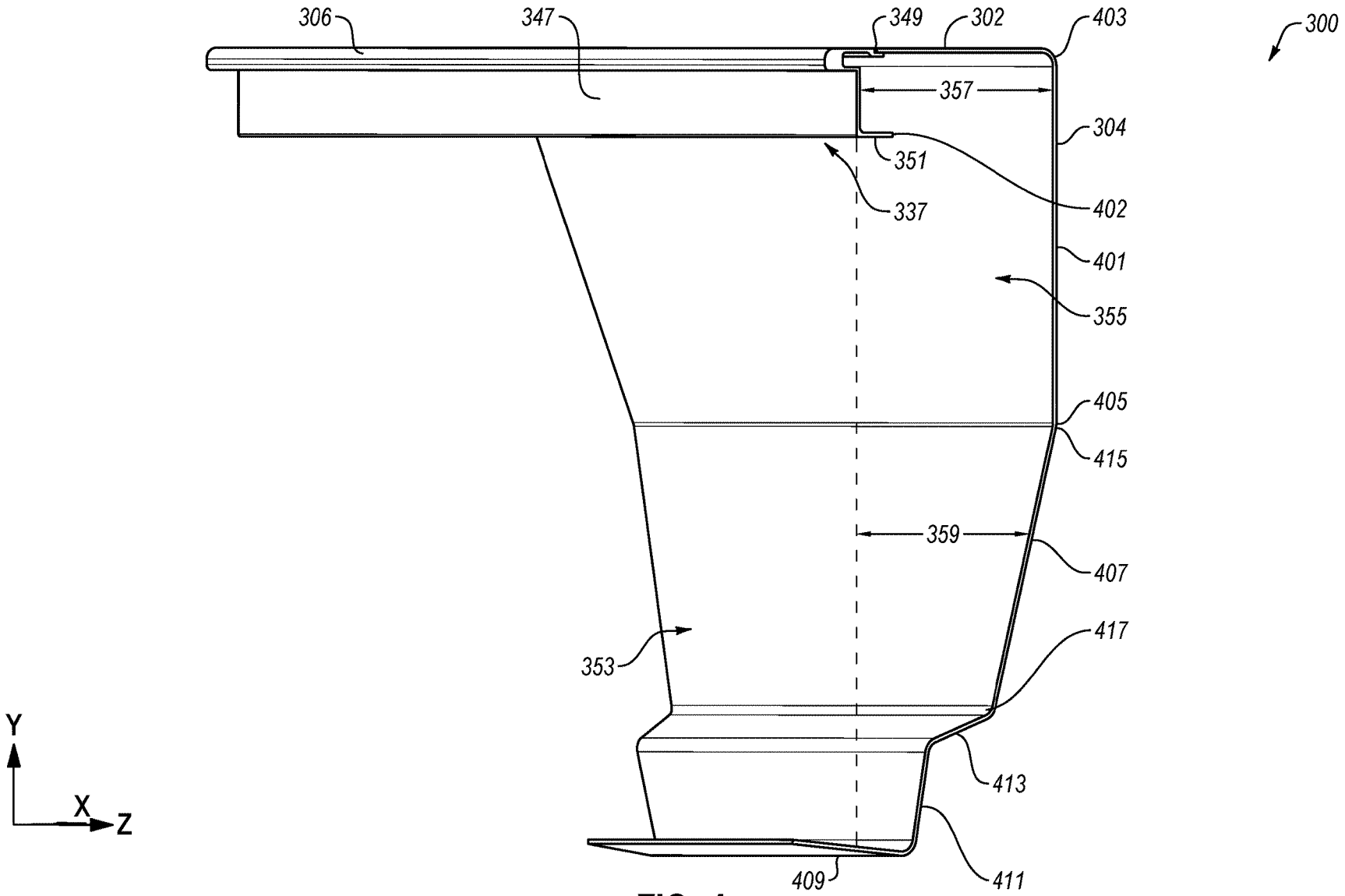
FIG. 4 depicts an example hull collar structure that may be included in the collar assembly of FIGS. 3A-3C.

FIG. 4 depicts an example embodiment of the hull collar structure 300. The hull collar structure 300 may be included in the boat hull 100 of FIGS. 1A-1F. The hull collar structure 300 may define the foam cavity 310 that is configured to receive a foam module such as the foam module 500. The hull collar structure 300 may include the gunwale 302, the outboard boundary 304, and the inboard boundary 306. The hull collar structure 300 may be open or non-closed. For instance, the outboard boundary 304 may not connect with the inboard boundary 306. The hull collar structure 300 may have a generally open C-shaped structure. As introduced above, the hull collar structure 300 may be open or non-closed to an encapsulated volume (e.g., the encapsulated volume 102 of FIGS. 1A-1F) or some portion thereof.

The gunwale 302 may be positioned at an uppermost (e.g., having a highest y-dimension) portion of the hull collar structure 300. The gunwale 302 may extend between the outboard boundary 304 and the inboard boundary 306. The gunwale 302 may be substantially planar, as shown in FIG. 4. In other embodiments, the gunwale 302 may be arced, either concaved or convex.

The outboard boundary 304 may be positioned outboard relative to the inboard boundary 306. The outboard boundary 304 generally includes an outer structure of a boat hull and may extend around all or a portion of a boat hull. For instance, the outboard boundary 304 may extend in an outward lateral direction (e.g., the x-direction) from a lower hull portion such as the lower hull portion 202 of FIGS. 1A-1F. In addition, the outboard boundary 304 may extend in a longitudinal direction (e.g., the y-direction of FIG. 4) from the lower hull portion. Extension of the outboard boundary 304 in the longitudinal direction may enable at least a portion of the hull collar structure 300 to be in a freeboard portion of a boat hull and/or above a waterline. It may be understood that the freeboard portion and the waterline may differ depending on how a boat is loaded, the operating condition of the boat, the water conditions, and the like. Nevertheless, configuration of the outboard boundary 304 in at least some embodiments may enable at least a portion of the hull collar structure 300 to be maintained in a freeboard portion of a boat hull and/or above the waterline.

The outboard boundary 304 of FIG. 4 includes a first longitudinal element 401, a first angled element 407, a first lateral element 409, a second longitudinal element 411, and a second lateral element 413. The first longitudinal element 401 includes a first end 403 and a second end 405. The first end 403 of the first longitudinal element 401 is connected to the gunwale 302. The first longitudinal element 401 is substantially oriented in a plane that is parallel to the YZ plane of FIG. 4.

The first angled element 407 extends from the second end 405 of the first longitudinal element 401. The first angled element 407 may be angled in an inboard direction. For example, the first angled element 407 may include a first end 415 that connects the second end 405 of the first longitudinal element 401. The first angled element 407 may also include a second end 417 that connects to the second lateral element 413. The second end 417 of the first angled element 407 may be positioned inboard of the first end 415 of the first angled element 407. The second lateral element 413 may be connected to the first angled element 407. The second lateral element 413 may extend substantially in the outboard direction from the second longitudinal element 411. The second longitudinal element 411 may be connected to the first lateral element 409 and may extend substantially in the longitudinal direction (e.g., the y-direction of FIG. 4) from the first lateral element 409 to the second lateral element 413. The first lateral element 409 may be connected to the second longitudinal element 411 and may extend in the outboard direction from a lower hull portion such as the lower hull portion 202 described above.

The example outboard boundary 304 described above is not meant to be limiting. For instance, in other embodiments, the outboard boundary 304 may include a different arrangement and/or a different number of elements. For instance, the first angled element 407, the second longitudinal element 411, and the second lateral element 413 may be combined into a single element. Additionally or alternatively, one or more of the elements (409, 411, 413, 407, and 401) may be curved or arced.

With reference to FIGS. 2 and 4, the deck 106 may extend over a portion of the first lateral element 409. The deck 106 may be separated from the first lateral element 409 by a deck height 451. Additionally, the deck lip 700, which may be connected to the deck 106, may extend in the longitudinal direction towards the inboard boundary 306. The inboard boundary 306 extends from the gunwale 302 a portion of a distance to the deck 106 or the deck lip 700. Accordingly, the distance 345 is defined between the deck lip 700 and a free end 402 of the inboard boundary 306. The hull collar structure 300 is at least partially open to an inner hull volume such as the encapsulated volume 102.

Referring to FIG. 4, the inboard boundary 306 includes the longitudinal portion 347. The longitudinal portion 347 connects to the gunwale 302 at a first end 349. The first longitudinal portion 347 extends in substantially the y-direction of FIG. 4. The inboard boundary 306 includes the lip structure 337 at the free end 402 that is opposite the first end 349. In the depicted embodiment, the lip structure 337 includes a lateral portion 351 and a longitudinal portion 347. The lateral portion 351, the longitudinal portion 347, or portions thereof may be configured to retain a foam module such as the foam module 500. For example, as described elsewhere in the present disclosure, the lateral portion 351 or portions thereof may be configured to be received in the recess 510. When the lip structure 337 is received in the recess 510, the foam module 500 is substantially retained relative to the hull collar structure 300.

The hull collar structure 300 defines the foam cavity 310 that receives the foam module 500. The foam cavity 310 includes a lower volume 353 and an upper volume 355. The upper volume 355 includes an uppermost portion that is positioned immediately below the gunwale 302. The lower volume 353 is the portion of the foam cavity 310 below the upper volume 355. The upper volume 355 of the foam cavity 310 includes a greater lateral dimension 357 than a lateral dimension 359 of the lower volume 353. Accordingly, the outboard portion of the upper volume 355 is disposed farther outboard and farther inboard than the lower volume 353.

The hull collar structure 300 may be comprised of an aluminum or an aluminum alloy. For example, in these and other embodiments, the hull collar structure 300 may be formed through a series or set of bending processes. For instance, the hull collar structure 300 may be formed from a single sheet of aluminum or aluminum alloy that is substantially planar. The single sheet may then be bent to form the shape shown in FIG. 4. Alternatively, the hull collar structure 300 may be made from two or more sheets of aluminum or aluminum alloy, which may be welded or otherwise coupled to one another.

Figure 5:
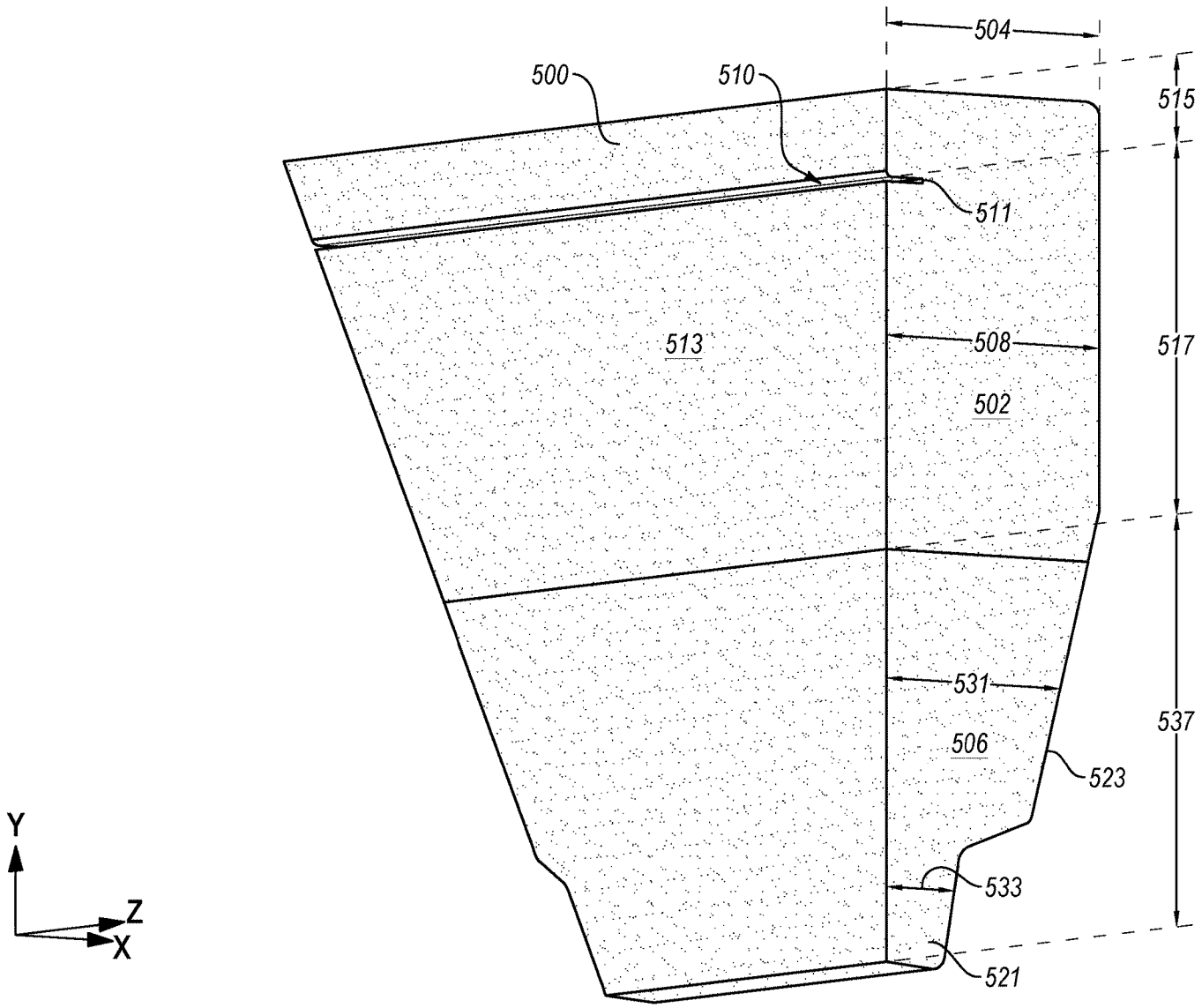
FIG. 5 illustrates an example foam module that may be implemented in the collar assembly of FIGS. 3A-3C.

FIG. 5 illustrates an example embodiment of the foam module 500. The foam module 500 may be implemented in the boat hull 100 of FIGS. 1A-1F. The foam module 500 may be comprised of one or more non-expansive, closed cell foams. The closed cell foams indicate that cells of the foam module are substantially enclosed by its walls. In closed cell foams, the cells may not be interconnected with one another. The closed cell foams may be formed by subjecting a rubber compound to a high-pressure gas or incorporating gas-forming materials into a compound. Some examples of closed cell foams may include neoprene, irradiated cross-linked polyethylene, chemically cross-linked polyethylene, Ethyl Vinyl Acetate (EVA), conductive polyolefins, static-dissipative or fire-retardant polyolefins, PVC, EPDM, vinyl nitrile, and the like. The closed cell foam of the foam module 500 may be less dense than water.

Additionally, the closed cell foam may be liquid resistant and/or non-expansive. For example, when the closed cell foam(s) is exposed to water or another liquid, the water may not be absorbed in the foam module 500. Additionally, the foam module 500 may not expand due to exposure to the water or due to exposure to ambient temperatures. In some embodiments, the foam module 500 may be comprised of a polyethylene foam.

The foam module 500 may be shaped for disposition within a hull collar structure such as the hull collar structure 300 described above. The foam module 500 may be a single piece of material or may be comprised of two or more pieces of material. For instance, in some embodiments, the foam module 500 may be configured for disposition within a hull collar structure that includes two or more volumes. In these and other embodiments, the foam module 500 may include an upper foam portion 502 and a lower foam portion 506. The upper foam portion 502 may be formed or cut independently from the lower foam portion 506. The upper foam portion 502 may be disposed in the hull collar structure 300, followed by the lower foam portion 506 or vice versa.

The upper foam portion 502 of FIG. 5 may include a first lateral dimension 504, a second lateral dimension 508, and the recess 510. In the depicted embodiment, the first lateral dimension 504 and the second lateral dimension 508 may be substantially the same. In other embodiments, the first lateral dimension 504 may be greater than the second lateral dimension 508. The upper foam portion 502 may include the first lateral dimension 504 over a first height 515 that corresponds to the position of the recess 510 and the second lateral dimension 508 over a second height 517. The first lateral dimension 504 and the first height 515 may configured to be received in a wide portion of the hull collar structure 300, which may be nearest a gunwale (e.g., 302). A second part of the upper foam portion 502 that includes the second lateral dimension 508 and the second height 517 may be positioned between the first part and the lower foam portion 506.

The recess 510 may be defined to receive a lip structure of a hull collar structure such as the hull collar structure 300. The recess 510 may be defined at a transition between the first lateral dimension 504 and the second lateral dimension 508 or in another suitable location on the foam module 500. The recess 510 may include an indent 511, which includes a cutout or notch that is outboard relative to an internal surface 513 of the foam module 500. In the depicted embodiment, the recess 510 is a relatively thin rectangular cutout. In other embodiments, the recess may be formed as a rounded feature, a hooked-shaped feature, a concave feature, or another suitable feature.

An upper portion of the hull collar structure 300 may accordingly extend over the first part of the upper foam portion 502. When the upper portion of the hull collar structure 300 is positioned over the first part, the lip structure 337 or a portion thereof may be received in the recess 510 and the foam module 500 may be retained relative to the hull collar structure 300.

The lower foam portion 506 of FIG. 5 may include a third lateral dimensions 531 and a fourth lateral dimension 533. The third lateral dimension 531 may be defined between an outer edge 523 and the internal surface 513. The third lateral dimension 531 may vary from the second lateral dimension 508 to the fourth lateral dimension 533. In the depicted embodiment, the third lateral dimension 531 may vary substantially linearly over two portions of the lower foam portion 506.

The fourth lateral dimension 533 may be a dimension of a bottom part 521 of the lower foam portion 506. The bottom part 521 may be below a waterline (dynamic and static) when a boat hull implementing the foam module 500 is in the water. The bottom part 521 may be a narrowest part of the foam module 500 and the foam module 500 may increase in thickness and may extend outboard from the internal surface 513 as the foam module 500 increases in height from the bottom part 521.

In some embodiments, the lower foam portion 506 may include a cutout, which may be formed by removing material from the internal surface 513. The cutout may be sized and configured to receive the deck lip 700 or another structure that may be introduced into the foam module 500. For instance, the cutout may be configured such that an uppermost edge of the deck lip 700 may abut an upper edge of the cutout. A depth of the cutout may substantially correspond to a thickness of the deck lip 700 or another structure introduced or place against the foam module 500.

In some embodiments, the foam module 500 may only fill a portion of the hull collar structure 300. For instance, the foam module 500 may comprise only the upper foam portion 502 and may omit the lower foam portion 506. Additionally or alternatively, a cavity (e.g., a rectangular or domed cavity) may be defined in the internal surface 513. The cavity may be sized and configured to receive and store equipment. In these and other embodiments, the panel 331 may include a corresponding structure that fits into the cavity, which may allow storage in the cavity.

One or more of the dimensions (e.g., 508, 504, 531, 533, etc.) may be sized such that a boat hull (e.g., 100) implementing the foam module 500 substantially complies with level floatation requirements. For example, to increase buoyancy of the boat hull, the first, second, third, or fourth lateral dimensions of the foam module 500 may be increased. Similarly, to increase buoyancy of the boat hull, a height 537 of the foam module 500 may be increased.

Figure 6B:
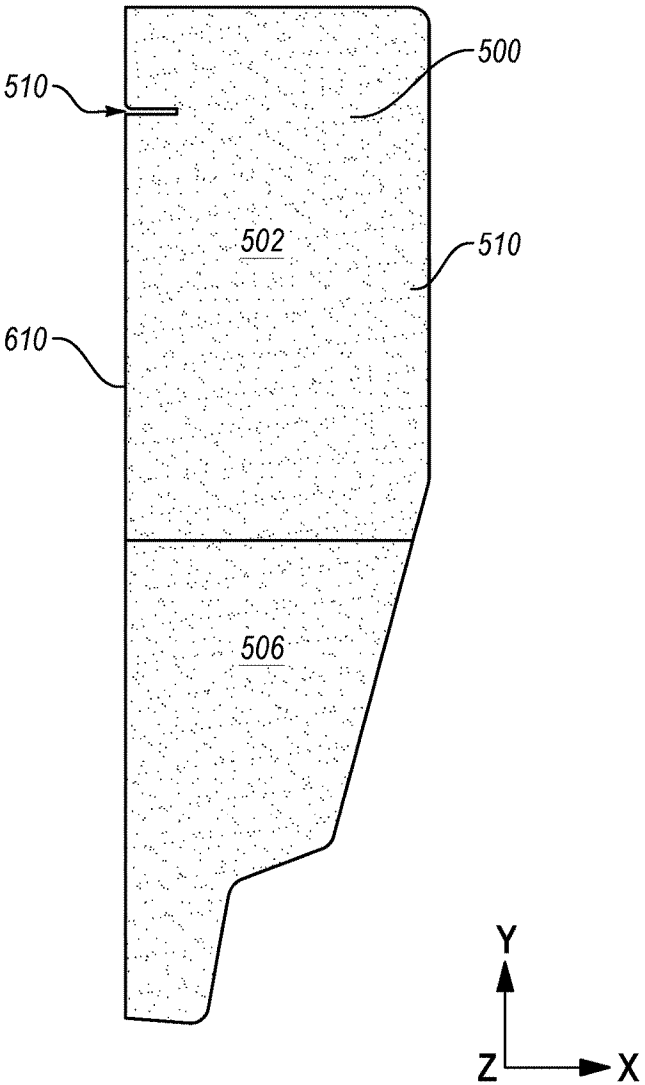
FIG. 6B depicts a cross-sectional views of an example embodiment of the foam module 500 that may be implemented in the collar assembly of FIGS. 3A-3C.
Figure 6A:
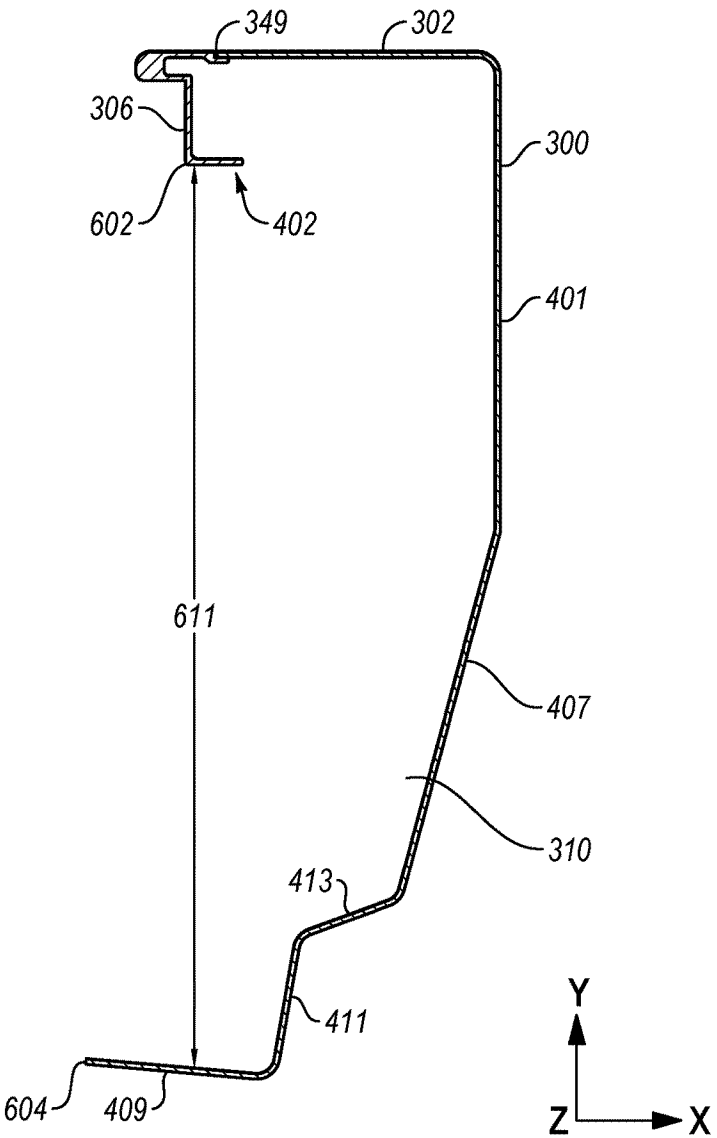
FIG. 6A depicts a cross-sectional view of an example embodiment of the hull collar structure that may be implemented in the collar assembly of FIGS. 3A-3C.

FIGS. 6A and 6B depict cross-sectional views of an example embodiment of the hull collar structure 300 and an example embodiment of the foam module 500, respectively. The hull collar structure 300 may include a shape that corresponds or substantially corresponds to a shape of the foam module 500. For instance, the hull collar structure 300 includes a partial perimeter that extends from the free end 402 and a second end 604. Within the partial perimeter, the foam cavity 310 is defined, which is described elsewhere in the present disclosure. In the embodiment of FIG. 6A, a datum 611 may extend longitudinally from a corner 602 to the first lateral element 409. The hull collar structure 300 includes a portion of the first lateral element 409 that is inboard of the datum 611. The portion of the first lateral element 409 may be connected to or otherwise coupled to the lower hull portion (e.g., 202).

In these and other embodiments, the shape of the foam module 500 substantially corresponds to the shape of the partial perimeter and the datum 611. For instance, the lower foam portion 506 may be shaped with similar or identical angles and/or dimensions as the first lateral element 409, the second longitudinal element 411, the second lateral element 413, and a portion of the first angled element 407. Similarly, the upper foam portion 502 may include similar or identical angles and/or dimensions as another portion of the first angled element 407, the longitudinal element, the gunwale 302, and the inboard boundary 306.

In some embodiments in which the foam module 500 includes a cutout and/or the recess 510 includes a concaved portion, the foam module 500 may include an inboard extended portion that extends a small amount (e.g., between about 0.125 inches and about 0.75 or another suitable amount) past the datum 611 in the inboard direction. The inboard-extended portion may at least partially define the recess 510 of the foam module 500. The inboard-extended portion may be configured to abut a panel in some embodiment. In these and other embodiments, aside from the inboard-extended portion, the shape of the foam module 500 substantially corresponds to the shape of the partial perimeter and the datum 611.

The depicted embodiment is not meant to be limiting as to the particular geometry of the foam module 500 or the hull collar structure 300. For instance, the foam module 500 may only comprise the upper foam portion 502. In these embodiments, the upper foam portion 502 may include a shape that corresponds to a portion of the hull collar structure 300. Additionally, as described above, the hull collar structure 300 may include a different set of elements that have different lengths and sizes from those depicted. In these embodiments, the foam module 500 may include a shape that corresponds to the hull collar structure 300.

Figure 7:
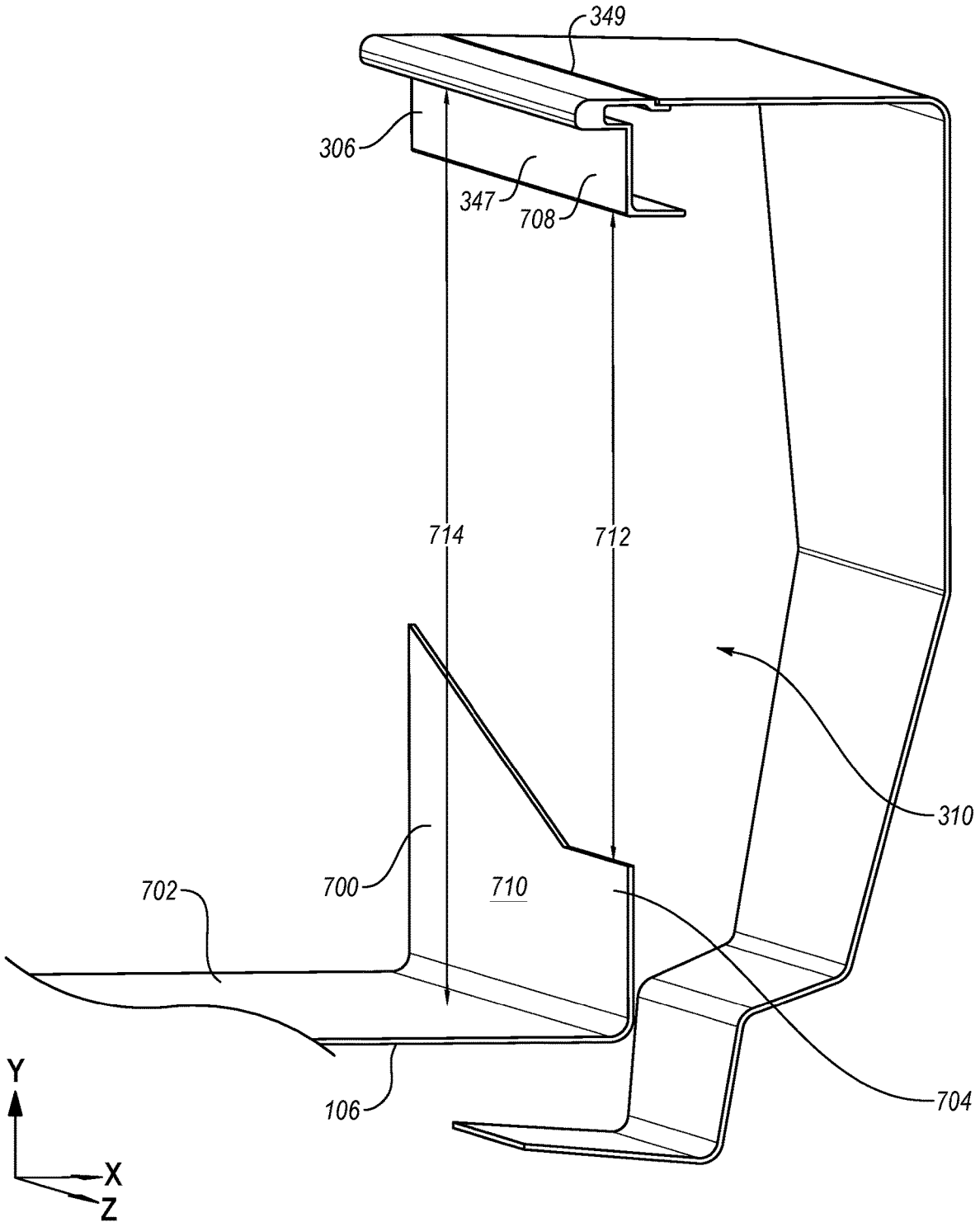
FIG. 7 illustrates an example embodiment of the deck lip that may be implemented in the boat hull of FIGS. 1A-1F.

FIG. 7 illustrates an example embodiment of the deck lip 700 that may be implemented in the boat hull 100 of FIGS. 1A-1F. The deck lip 700 may include a portion of a deck such as the deck 106 or may include an independent component that is used with a deck such as the deck 106. For instance, the deck lip 700 may be formed as an outboard portion (e.g., outer about 3% to about 10% or another suitable portion) of the deck 106 or may be formed independently and added to or otherwise coupled to the deck 106.

The deck lip 700 may be configured to substantially prevent introduction of water into the foam cavity 310 defined by the hull collar structure 300 from the deck 106. For example, during use of a boat implementing the deck lip 700, water may enter the encapsulated volume such as the encapsulated volume 102 due to waves crashing on a side of the boat. The water may rest on a top surface 702 of the deck 106. As the boat rocks (e.g., due to waves or rough seas), the water may move in substantially a lateral direction, which corresponds to the x direction of FIG. 7. A vertical portion 704 of the deck lip 700 may extend substantially in a longitudinal direction relative to the top surface 702. In FIG. 7, the longitudinal direction may correspond to the y-direction. The vertical portion 704 may confine at least a portion of the water to the top surface 702 of the deck 106 and prevent or reduce an amount of the water that is introduced into the foam cavity 310.

In general, in some embodiments, the deck 106 may be implemented in a boat that includes a self-baling deck configuration. In self-baling deck configurations, the water that accumulates on the top surface 702 of the deck 106 may be directed towards an aft portion of the boat where a bailing valve, a scupper, or another suitable bailing mechanism may be implemented. The bailing valve or the scupper may enable the water to be directed overboard. Accordingly, the deck lip 700 may be configured to prevent or reduce the introduction of the water to the foam cavity 310 prior to the water being directed to the bailing valve or the scupper.

In the embodiment of FIG. 7, the deck lip 700 may protrude in the longitudinal direction towards the inboard boundary 306. In some embodiments, the vertical portion 704 may be coplanar or substantially coplanar with the inboard boundary 306. For instance, deck lip 700 and the longitudinal portion 347 of the lip structure 337 are positioned at substantially a same distance outboard from a keel. Accordingly, the inboard boundary 306 and the vertical portion 704 may be oriented in a single plane that is substantially parallel to the YZ plane. In these and other embodiments, a panel such as the panel 331 may be configured to abut front surfaces 708 and 710 of the inboard boundary 306 and the vertical portion 704, respectively. In particular, the panel (e.g., 331) may be sized in the longitudinal direction (e.g., the y-direction) to cover a first distance 714 that is greater than a second distance 712 between the longitudinal portion 347 of the lip structure 337 and the deck lip 700. The panel may accordingly seal or partially seal an open portion of the foam cavity 310.

In the depicted embodiment, the second distance 712 may change. For instance, at least a portion of the vertical portion 704 may be angled or sloped. In other embodiments, the vertical portion 704 may not be sloped or may include another slope. In some of these other embodiments, the second distance 712 may be substantially constant.

In other embodiments, the deck lip 700 and the inboard boundary 306 may not be aligned. For instance, the deck lip 700 may be farther or closer to the keel than the inboard boundary 306. Accordingly, the panel may have a non-planar configuration (e.g., bent or arced).

In the embodiment of FIG. 7, the deck lip 700 may extend along edges of the deck 106. In some embodiments, the deck lip 700 may only be included along a portion of the edges of the deck 106. In addition, in some embodiments, the vertical portion 704 may have different heights relative to the top surface 702 at different portions of the edges. For instance, near a forward portion of the deck 106, the deck lip 700 may have a smaller height than at an aft portion of the deck 106.

Figure 8:
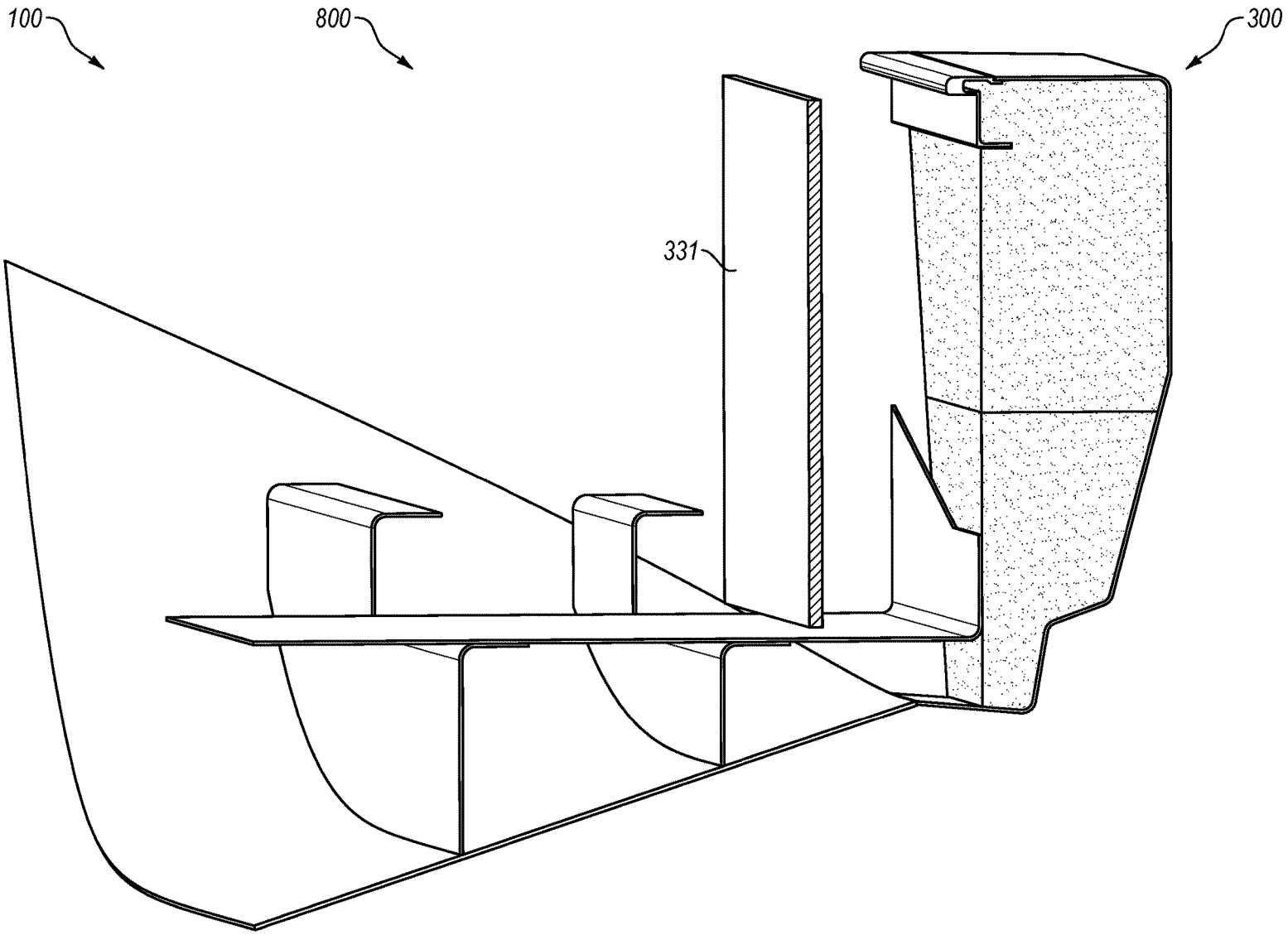
FIG. 8 illustrates an example collar assembly configuration that may be implemented in the boat hull of FIGS. 1A-1F, all in accordance with at least one embodiment described above.

FIG. 8 illustrates an example collar assembly configuration 800 that may be implemented with one or more of the embodiments described above. In the configuration 800, the hull collar structure 300 and the panel 331 may be independent of one another. For instance, the boat hull 100 may be sold with the hull collar structure 300 without the panel 331 or with a first embodiment of the panel 331. At a subsequent time, the panel 331 may be installed, changed, or upgraded. The panel 331 may be coupled to the hull collar structure 300 using fasteners, an epoxy, a sealant, or another suitable coupling material or system. Installation or modification of the panel 331 may enable a change or a modification to a function of the boat hull 100.

In some examples, the configuration 800 may be implemented for law enforcement applications. In these and other examples, the boat hull 100 may be initially sold without the panel 331. Later, the boat hull 100 may be upgraded to add the panel 331. Additionally or alternatively, the boat hull 100 may be initially sold with a first embodiment of the panel 331, which may be constructed of aluminum, fiberglass, or carbon fiber. At a later time, a second embodiment of the panel 331, which may be constructed of a ballistic material, may be substituted for the first embodiment of the panel 331. Similarly, the boat hull 100 may be initially sold with the second embodiment of the panel 331, which is constructed of the ballistic material. Later, the first embodiment of the panel 331, constructed of fiberglass etc., may be substituted for the second embodiment of the panel 331. In these and other examples, the boat hull 100 may be repurposed for another function suitable for the particular panel that is installed in the boat hull 100.

Moreover, in the configuration 800, one or more of the panels 331 may vary at different portions of the boat hull 100. For instance, in portions of the boat hull 100 that surround operators of the boat may be fitted with an embodiment of the panel 331 that are constructed of the ballistic material. Other portions of the boat hull 100, which may be away from the operators, may be fitted with another embodiment of the panel 331 that are constructed of another material. Accordingly, the boat hull may be armored in a customized fashion.

Another potential benefit of the configuration 800 may include relatively easy removal of the panels 331. The panels 331 may be removed from the boat hull 100 for repairs. For instance, if the boat hull 100 is dented, the panels 331 may be removed to provide access to an inner surface of the boat hull 100.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. An open/non-closed hull collar assembly, the assembly comprising:

a hull collar structure that includes:

a gunwale that includes an outboard edge;

an outboard boundary that is connected to the outboard edge of the gunwale, the outboard boundary extending in an outward lateral direction from a lower hull portion and extending in a longitudinal direction from the lower hull portion; and a lower chine included as a portion of the outboard boundary, the lower chine including an outboard portion, wherein:

the outboard boundary defines an open/non-closed inner hull volume; and the open/non-closed inner hull volume includes an expanded volume that is outboard of a datum plane defined between the outboard edge of the gunwale and the outboard portion of the lower chine.

2. The assembly of claim 1, wherein:

a lower chine angle is defined between a lower chine element of the lower chine and a first datum, the first datum extending in a lateral direction from a connection between an outermost edge of a lower hull portion and the lower chine element of the lower chine such that the first datum is oriented substantially parallel to a deck, and the lower chine angle is between about −10 degrees and about 10 degrees.

3. The assembly of claim 2, wherein the lower chine angle is about −5 degrees.

4. The assembly of claim 1, wherein the outboard boundary includes a second chine that is outboard of the lower chine.

5. The assembly of claim 4, wherein the lower chine and second chine are included in a single extrusion that is welded to a first lateral element and a first angled element of the outboard boundary.

6. The assembly of claim 4, wherein:

a second chine angle is defined between a second chine element of the second chine and a second datum, the second datum extending in a lateral direction from an intersection of the second chine element and a subsequent inboard element of the hull collar structure such that the second datum is substantially parallel to the deck and the first datum, and the second chine angle is in a range from about −10 degrees to about 50 degrees.

7. The assembly of claim 6, wherein the second chine angle is about 23 degrees.

8. The assembly of claim 1, wherein:

a chine line is defined substantially perpendicular to the gunwale and intersecting the outboard portion of the lower chine; and an angle between the datum plane and the chine line is about 13 degrees.

9. The assembly of claim 8, wherein:

a portion of the gunwale extends inboard of the chine line; and a portion of the open/non-closed inner hull volume is inboard of the lower chine.

10. The assembly of claim 1, further comprising a foam module that is shaped for disposition within the hull collar structure.

11. The assembly of claim 10, wherein the foam module is comprised of a non-expansive, closed cell foam.

12. The assembly of claim 10, wherein:

the hull collar structure includes an inboard boundary that extends from an inboard edge of the gunwale a portion of a distance to a deck;

the inboard boundary includes a first longitudinal element, a first end, and a free end opposite the first end;

the inboard boundary connects to the gunwale at the first end;

the inboard boundary includes a lip structure at the free end; and the foam module includes a recess that is configured to receive the lip structure such that the foam module is substantially retained relative to the hull collar structure.

13. The assembly of claim 12, further comprising a panel that is sized to extend from the inboard boundary to the deck in the longitudinal direction and to at least partially close the hull collar structure relative to the open/non-closed inner hull volume.

14. The assembly of claim 1, wherein the outboard boundary includes two or more elements that extend at two or more angles relative to the gunwale.

15. The assembly of claim 14, wherein the two or more elements include:

a first longitudinal element connected to the gunwale at a first end;

a first angled element that extends from a second end of the first longitudinal element;

a first lateral element that extends in an outboard direction from the lower hull portion;

a second longitudinal element connected to the first lateral element and extending in a longitudinal direction from the first lateral element; and a second lateral element that extends in the outboard direction from the second longitudinal element and connects to the first angled element.

16. A boat hull comprising:

a lower hull portion comprising an outer surface that is configured for contact with water when the boat hull is in water;

a deck mechanically coupled to the lower hull portion;

a hull collar assembly including:

a gunwale having an outboard edge;

an outboard boundary that extends in an outward lateral direction from the lower hull portion and that extends in a longitudinal direction from the lower hull portion;

a lower chine included as a portion of the outboard boundary, the lower chine including an outboard portion; and a second chine that is outboard of the lower chine, wherein the outboard boundary defines an open/non-closed inner hull volume having a portion that is outboard of a datum plane defined between the outboard edge of the gunwale and the outboard portion of the lower chine.

17. The boat hull of claim 16, wherein:

a lower chine angle is defined between a lower chine element of the lower chine and a first datum, the first datum extending in a lateral direction from a connection between an outermost edge of a lower hull portion and the lower chine element of the lower chine such that the first datum is oriented substantially parallel to a deck;

the lower chine angle is between about −10 degrees and about 10 degrees;

the outboard boundary includes a second chine that is outboard of the lower chine;

a second chine angle is defined between a second chine element of the second chine and a second datum, the second datum extending in a lateral direction from an intersection of the second chine element and a subsequent inboard element of the hull collar structure such that the second datum is substantially parallel to the deck and the first datum; and the second chine angle is in a range from about −10 degrees to about 50 degrees.

18. The boat hull of claim 17, wherein:

the second chine angle is about 23 degrees; and the lower chine angle is about −5 degrees.

19. The boat hull of claim 16, wherein:

a chine line is defined perpendicular to the gunwale and intersecting the outboard portion of the lower chine; and an angle between the datum plane and the chine line is about 13 degrees;

a portion of the gunwale extends inboard of the chine line; and a portion of the open/non-closed inner hull volume is inboard of the lower chine.

20. The boat hull of claim 16, further comprising:

a foam module shaped for disposition in the outboard boundary and comprised of a non-expansive, closed cell foam;

an inboard boundary that extends from the gunwale a portion of a distance to the deck such that the hull collar assembly is at least partially open or non-closed; and a panel that is sized to extend from the inboard boundary to the deck in the longitudinal direction and to at least partially close the hull collar assembly relative to the open/non-closed inner hull volume.

* * * * *